US008944154B2

(12) United States Patent
Takahashi et al.

(10) Patent No.: US 8,944,154 B2
(45) Date of Patent: Feb. 3, 2015

(54) HEAT EXCHANGER

(75) Inventors: Eizou Takahashi, Chiryu (JP); Mitsuru Kimata, Nishikasugai (JP); Akira Yamanaka, Gifu (JP); Masaya Nakamura, Kariya (JP); Yasuhiro Mizuno, Kariya (JP)

(73) Assignee: Denso Corporation, Kariya (JP)

( * ) Notice: Subject to any disclaimer, the term of this patent is extended or adjusted under 35 U.S.C. 154(b) by 880 days.

(21) Appl. No.: 12/925,963

(22) Filed: Nov. 3, 2010

(65) Prior Publication Data

US 2011/0168372 A1 Jul. 14, 2011

(30) Foreign Application Priority Data

Nov. 6, 2009 (JP) ..... 2009-254941

(51) Int. Cl.

| | |
|---|---|
| ***F28F 11/00*** | (2006.01) |
| ***F28F 9/02*** | (2006.01) |
| ***F28D 7/10*** | (2006.01) |
| ***F28D 1/04*** | (2006.01) |

(52) U.S. Cl.

CPC ..... *F28F 9/0209* (2013.01); *F28D 1/0443* (2013.01); *F28F 9/0226* (2013.01); *F28F 2275/122* (2013.01); *F28F 2230/00* (2013.01); *F28F 2270/02* (2013.01)

USPC ..... 165/140; 165/70; 165/173; 165/174

(58) Field of Classification Search

USPC ..... 165/140, 148, 149, 173, 174, 70

See application file for complete search history.

(56) References Cited

U.S. PATENT DOCUMENTS

| | | | |
|---|---|---|---|
| 7,779,893 | B2 | 8/2010 | Leitch et al. |
| 2002/0036821 | A1 | 3/2002 | Hollemann et al. |
| 2002/0040776 | A1 | 4/2002 | Kokubunji et al. |
| 2003/0213587 | A1 | 11/2003 | Mano et al. |

(Continued)

FOREIGN PATENT DOCUMENTS

| | | |
|---|---|---|
| CN | 101135544 | 3/2008 |
| EP | 1895260 | 3/2008 |
| FR | 2712674 | 5/1995 |

(Continued)

OTHER PUBLICATIONS

Office Action issued Feb. 19, 2013 in corresponding Japanese Application No. 2009-254941 with English translation.

(Continued)

*Primary Examiner* — Judy Swann
*Assistant Examiner* — Jon T Schermerhorn
(74) *Attorney, Agent, or Firm* — Harness, Dickey & Pierce, PLC

(57) ABSTRACT

A heat exchanger has partitioning means for dividing a header tank such that a first space and a second space of a tank main body are arranged in a longitudinal direction of the header tank. An annular outer peripheral seal surface is provided around a tube bonding surface of a core plate of the header tank over an entire perimeter thereof and is provided with a gasket. A partitioning seal surface is provided to the tube bonding surface at a position corresponding to the partitioning means, and is provided with the gasket. The gasket seals between the core plate and the partitioning means. The partitioning seal surface is positioned on a plane identical with a plane of the outer peripheral seal surface. A part of the gasket, which is held by the core plate and the tank main body therebetween, has a uniform thickness.

17 Claims, 18 Drawing Sheets

(56) References Cited

U.S. PATENT DOCUMENTS

| | | | | |
|---|---|---|---|---|
| 2008/0047687 | A1* | 2/2008 | Leitch et al. | 165/70 |
| 2008/0053645 | A1* | 3/2008 | Hakamata et al. | 165/173 |

FOREIGN PATENT DOCUMENTS

| | | |
|---|---|---|
| FR | 2785376 | 5/2000 |
| JP | S59-134781 | 8/1984 |
| JP | S61-115862 | 7/1986 |
| JP | 62070284 U | 5/1987 |
| JP | 2002-115991 | 10/2000 |
| JP | 2002-141589 | 8/2001 |
| JP | 2003-336993 | 5/2002 |
| JP | 2003-336994 | 11/2003 |
| JP | 2003-336995 | 11/2003 |
| JP | 2006-145165 | 6/2006 |
| JP | 2007-032952 | 2/2007 |

OTHER PUBLICATIONS

Office Action mailed Feb. 24, 2012 issued in corresponding Chinese Application No. 201010535083.6 with English translation thereof.

Office Action issued Mar. 4, 2014 in corresponding JP Application No. 2013-88520 (Divisional Application of JP2009-254941) with English translation.

* cited by examiner

FIRST COMPARISON EXAMPLE

SECOND COMPARISON EXAMPLE

THIRD COMPARISON EXAMPLE

HEAT EXCHANGER

CROSS REFERENCE TO RELATED APPLICATION

This application is based on and incorporates herein by reference Japanese Patent Application No. 2009-254941 filed on Nov. 6, 2009

BACKGROUND OF THE INVENTION

1. Field of the Invention

The present invention relates to a heat exchanger having multiple heat exchanger units that are integrally formed.

2. Description of Related Art

Conventionally, JP-A-2002-115991 (corresponding to US2002/0040776) discloses a heat exchanger, which has multiple tubes allowing fluid to flow therethrough, and which has a header tank provided at longitudinal end portions of the tubes to be communicated with the tubes. Multiple heat exchanger units are integrally formed by partitioning an internal space of the header tank by partition walls (separators).

In the heat exchanger of JP-A-2002-115991, the header tank includes a core plate and a tank main body. The core plate has tube insertion bores, into which the tubes are inserted in a bonded manner. The tank main body, together with the core, plate, defines an in-tank space. Also, a gasket is provided at a position between the adjacent tube insertion bores of the core plate, and when the partition wall compresses the gasket, the gap between the partition wall and the core plate is sealed.

Also, JP-A-2003-336994 discloses a heat exchanger, in which a gap between the partition wall and the core plate is sealed by forming two plate members along a length of the end portion of the partition wall at the end portion of the partition wall adjacent the core plate, without providing a gasket.

Also, in the heat exchanger of JP-A-2002-115991, a position between tube insertion bores that are located adjacent the core plate serves as a seal surface, and the part is processed to have a burring for receiving a tube. Thus, the part between the tube insertion bores has a curved shape. Originally, in order to secure sealing performance for sealing between the partition wall and the core plate, it is required to apply a compression force perpendicular to the gasket uniformly. However, because the seal surface has the curved shape, it is difficult to apply the uniform compression force to the entirety of the seal surface, and thereby it is difficult to sufficiently secure the sealing performance.

Also, in the heat exchanger of JP-A-2003-336994, because the gasket is eliminated, it is disadvantageously impossible to sufficiently secure the sealing performance.

SUMMARY OF THE INVENTION

The present invention is made in view of the above disadvantages. Thus, it is an objective of the present invention to address at least one of the above disadvantages.

In order to achieve the objective of the present invention, there is provided a heat exchanger that includes a core unit and a pair of header tanks. The core unit has a plurality of tubes that allows fluid to circulate therethrough. The pair of header tanks is positioned at longitudinal end portions of the plurality of tubes. The pair of header tanks extends in a direction orthogonal to a longitudinal direction of the tubes to be communicated with the plurality of tubes. Each of the pair of header tanks has a core plate, to which the tubes are bonded, and a tank main body, which together with the core plate defines a tank space. The tank main body has at least a first main body segment and a second main body segment. The header tank is provided with partitioning means that divides the header tank into a first space, which is an internal space of the first main body segment, and a second space, which is an internal space of the second main body segment, such that at least the first space and the second space are arranged in a longitudinal direction of the header tank. The partitioning means has a first partitioning surface that faces the first space and has a second partitioning surface that faces the second space. A plurality of heat exchanger units is defined by dividing the core unit at the partitioning means in a direction, in which the first space and the second space are arranged. The core plate has a tube bonding surface, to which the tubes are bonded. The tube bonding surface has an annular outer peripheral seal surface formed therearound over an entire perimeter of the tube bonding surface. A seal member, which seals between the core plate and an end portion of the tank main body adjacent the core plate, is provided in the annular outer peripheral seal surface. The tube bonding surface has a partitioning seal surface at a position, which corresponds to the partitioning means. The seal member is provided at the partitioning seal surface to seal between the core plate and the partitioning means. The partitioning seal surface is positioned on a plane that is the same as a plane of the outer peripheral seal surface. The seal member has a part, which is held by the core plate and the tank main body therebetween, and which has a uniform thickness.

In order to achieve the objective of the present invention, there is also provided a heat exchanger that includes a core unit, a pair of header tanks, a partition wall, and a plurality of heat exchanger units. The core unit has a plurality of tubes that allows fluid to circulate therethrough. The pair of header tanks is provided at longitudinal end portions of the plurality of tubes. The pair of header tanks extends in a direction orthogonal to a longitudinal direction of the tubes to be communicated with the plurality of tubes. Each of the pair of header tanks has a core plate, to which the tubes are bonded, and a tank main body, which together with the core plate defines a tank space. The partition wall is provided within the header tank. The partition wall has a plate shape and divides the tank space into at least a first space and a second space. The first space and the second space are arranged in a longitudinal direction of the header tank. The plurality of heat exchanger units is defined by dividing the core unit at the partition wall in a direction, in which the first space and the second space are arranged. The core plate has a tube bonding surface, to which the tubes are bonded. The tube bonding surface has an annular outer peripheral seal surface formed therearound over an entire perimeter of the tube bonding surface. A seal member, which seals between the core plate and an end portion of the tank main body adjacent the core plate, is provided at the annular outer peripheral seal surface. The tube bonding surface has a partitioning seal surface at a position, which corresponds to the partition wall. The seal member is provided at the partitioning seal surface to seal between the core plate and the partition wall. The partitioning seal surface is positioned on a plane that is the same as a plane of the outer peripheral seal surface. The seal member has a part, which is held by the core plate and the tank main body therebetween, and which has a uniform thickness.

In order to achieve the objective of the present invention, there is also provided with a heat exchanger that includes a first core unit, a second core unit, a core plate, a first main body segment, a second main body segment, a seal member, and partitioning means. The first core unit has a plurality of first tubes that allows first fluid to flow therethrough. The second core unit has a plurality of second tubes that allows second fluid to flow therethrough. The core plate is connected with longitudinal end portions of the first tubes and the second tubes. The first main body segment is bonded to the core plate. The first main body segment extends in a direction orthogonal to a longitudinal direction of the first tubes such that the first main body segment defines a first space that is communicated with the first tubes. The second main body segment is bonded to the core plate. The second main body segment extends in a direction orthogonal to a longitudinal direction of the second tubes such that the second main body segment defines a second space that is communicated with the second tubes. The seal member seals between the core plate and the first main body segment and seals between the core plate and the second main body segment. The first space and the second space are arranged in the direction orthogonal to the longitudinal direction of the first tubes and the second tubes. The partitioning means separates the first space from the second space. The seal member seals between the core plate and one of the first main body segment, the second main body segment, and the partitioning means. The core plate includes a tube bonding surface, an annular outer peripheral seal surface, and a partitioning seal surface. The tube bonding surface has insert bores, into which the first and second tubes are inserted. The annular outer peripheral seal surface is formed around the tube bonding surface and is provided with the seal member. The partitioning seal surface is formed at a position opposed to an end portion of the partitioning means, and is provided with the seal member. The partitioning seal surface is positioned on a plane that is the same as a plane of the outer peripheral seal surface. The seal member has a part, which is held by the core plate and the one of the first main body segment, the second main body segment, the partitioning means therebetween, and which has a uniform thickness.

The invention, together with additional objectives, features and advantages thereof, will be best understood from the following description, the appended claims and the accompanying drawings in which:

Figure 18:
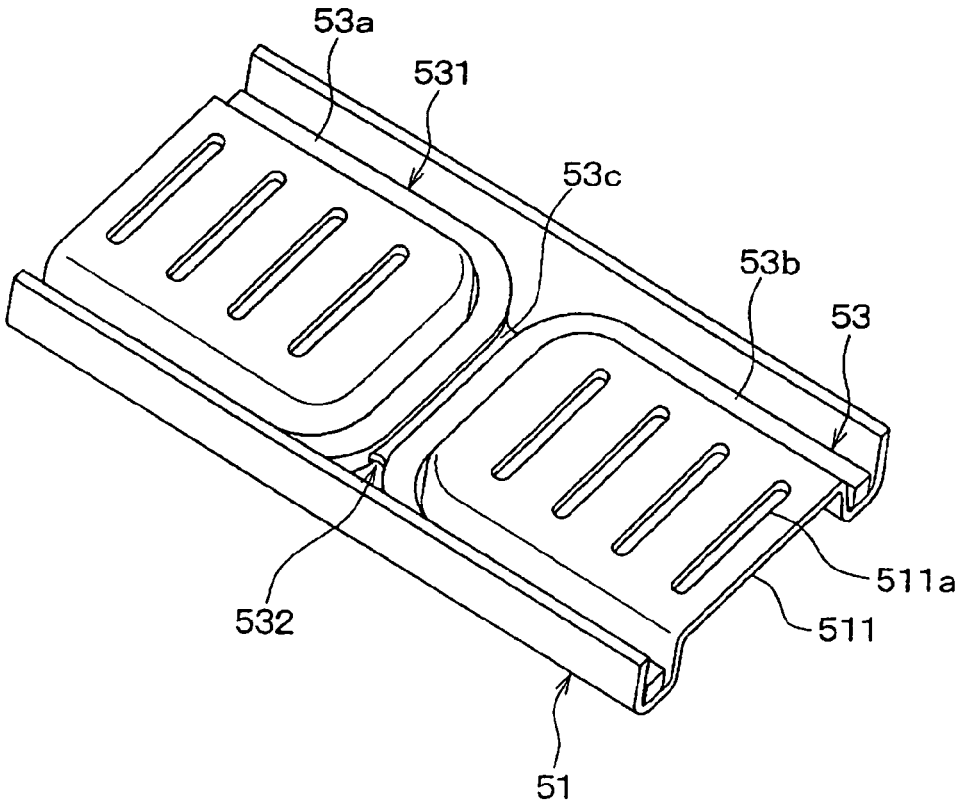
Figure 19:
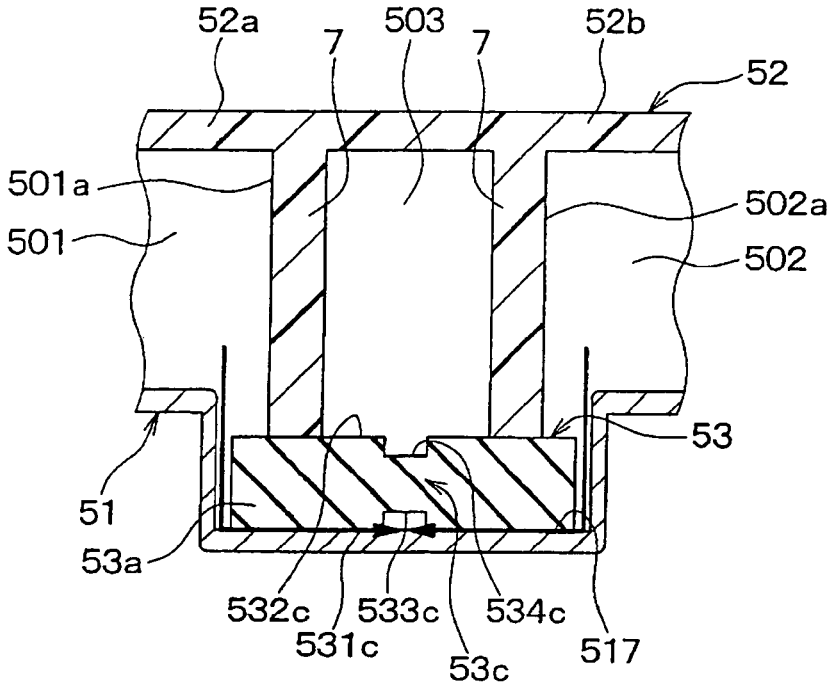
Figure 20:
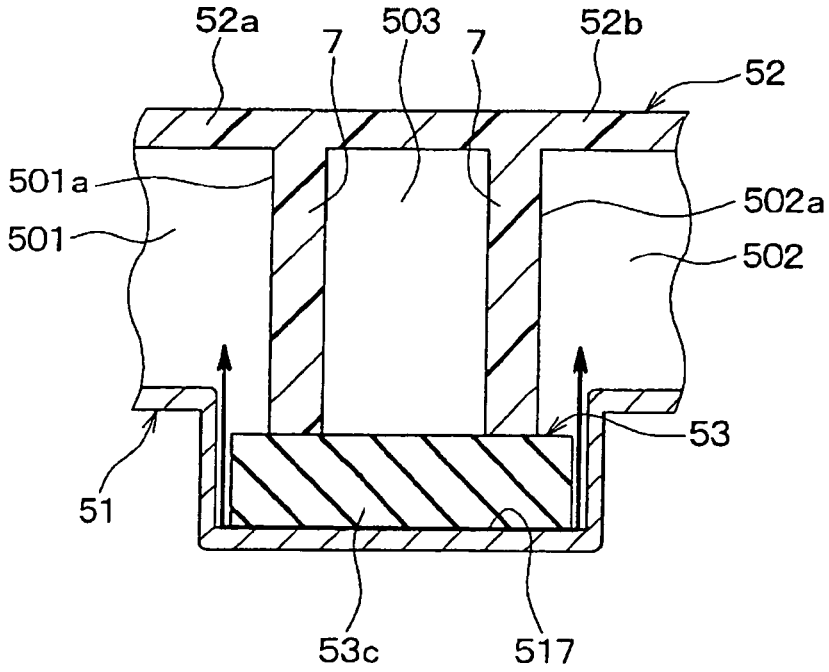
Figure 21:
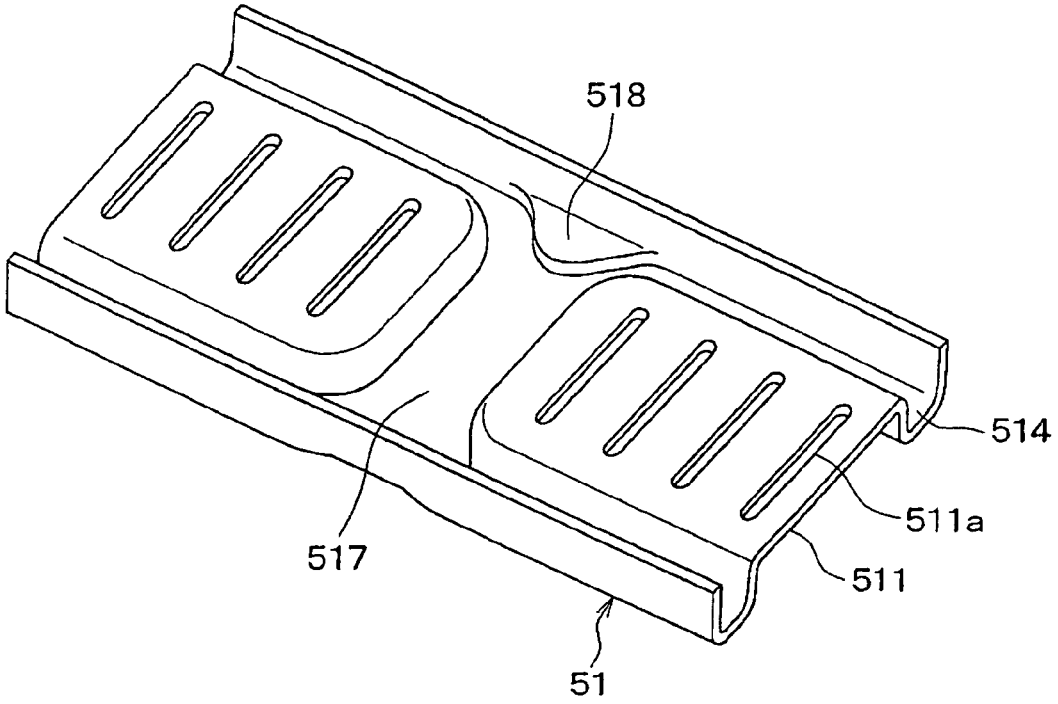
Figure 22:
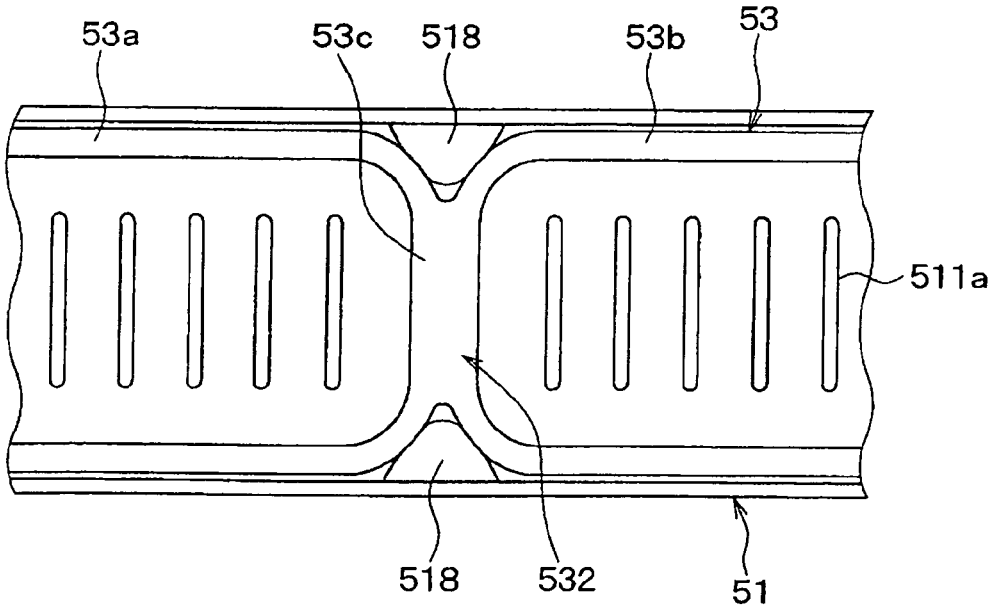
Figure 23:
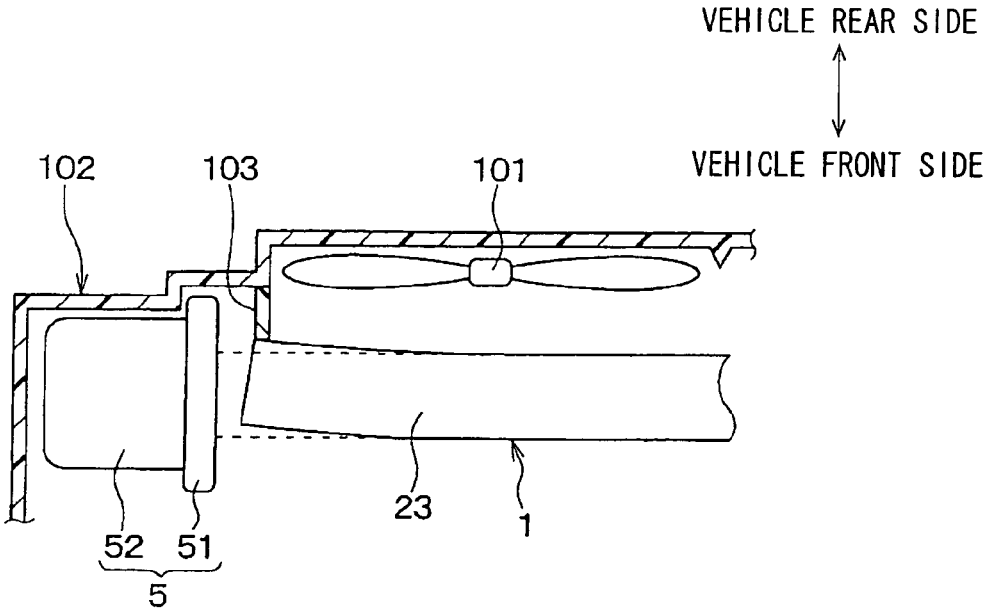
Figure 24:
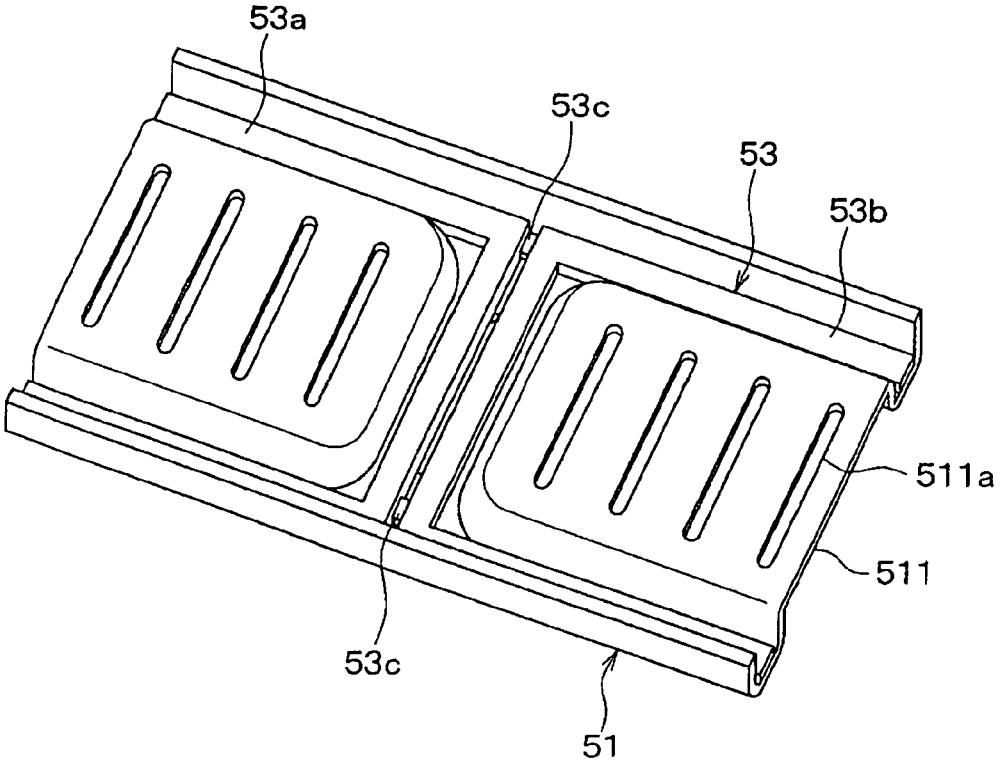
Figure 25:
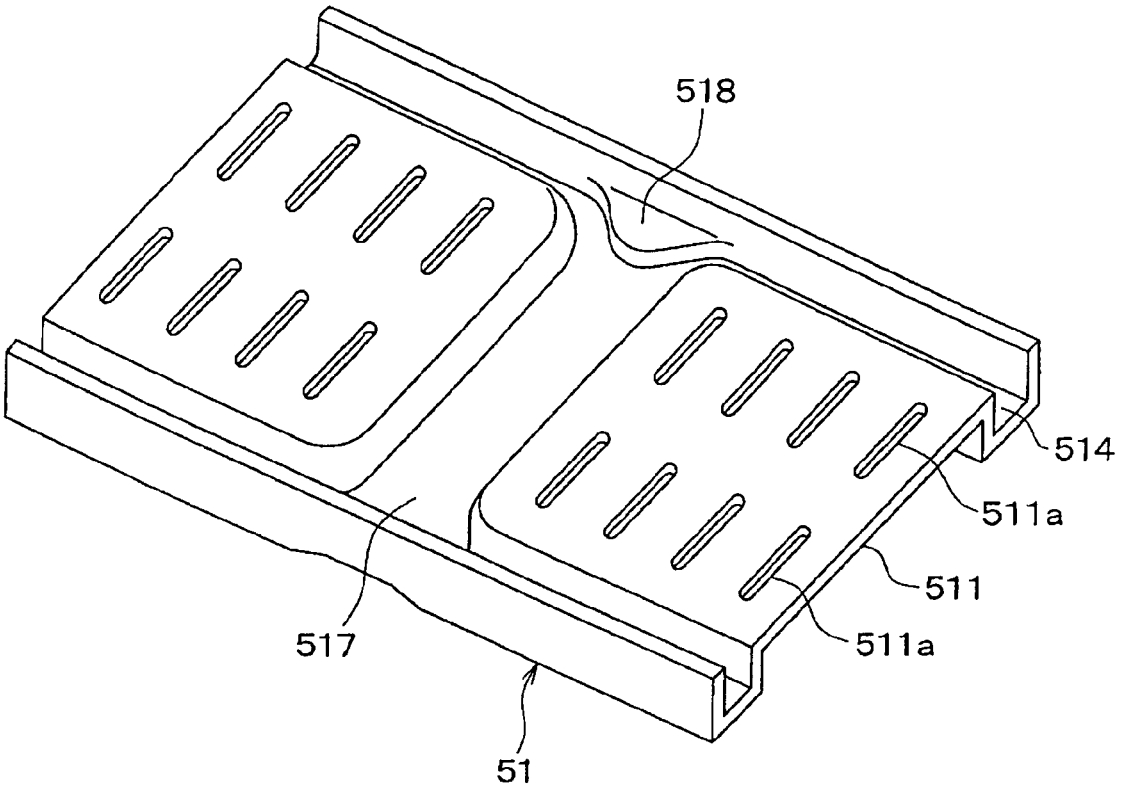

FIG. 18 is an enlarged perspective view illustrating a core plate 51 and a gasket 53 of a heat exchanger 1 according to the sixth embodiment;

FIG. 19 is an enlarged sectional view illustrating a main part of a header tank 5 according to the sixth embodiment;

FIG. 20 is an enlarged sectional view illustrating a main part of a header tank 5 according to the third comparison example;

FIG. 21 an enlarged perspective view illustrating a core plate 51 of a heat exchanger 1 of the seventh embodiment;

FIG. 22 is an enlarged plan view illustrating a core plate 51 and a gasket 53 of a heat exchanger 1 of the seventh embodiment;

FIG. 23 a schematic cross-sectional view illustrating a cooling module mounted to a heat exchanger 1 according to the eighth embodiment;

FIG. 24 is an enlarged perspective view illustrating a core plate 51 and a gasket 53 of a heat exchanger 1 according to the other embodiment; and FIG. 25 is an enlarged perspective view illustrating the core plate 51 of the heat exchanger 1 according to the other embodiment.

DETAILED DESCRIPTION OF PREFERRED EMBODIMENTS

Embodiments of the present invention will be described below with reference to the drawings. It should be noted that in each of the embodiments below, components identical with each other or similar to each other will be denoted by the same numerals.

First Embodiment

The first embodiment of the present invention will be described below with reference to FIGS. 1 to 9. The present embodiment describes an example of a case, where a heat exchanger according to the present invention is applied to a heat exchanger for a hybrid vehicle, in which a traveling drive force is obtained based on an engine and a driving electric motor.

Figure 1:
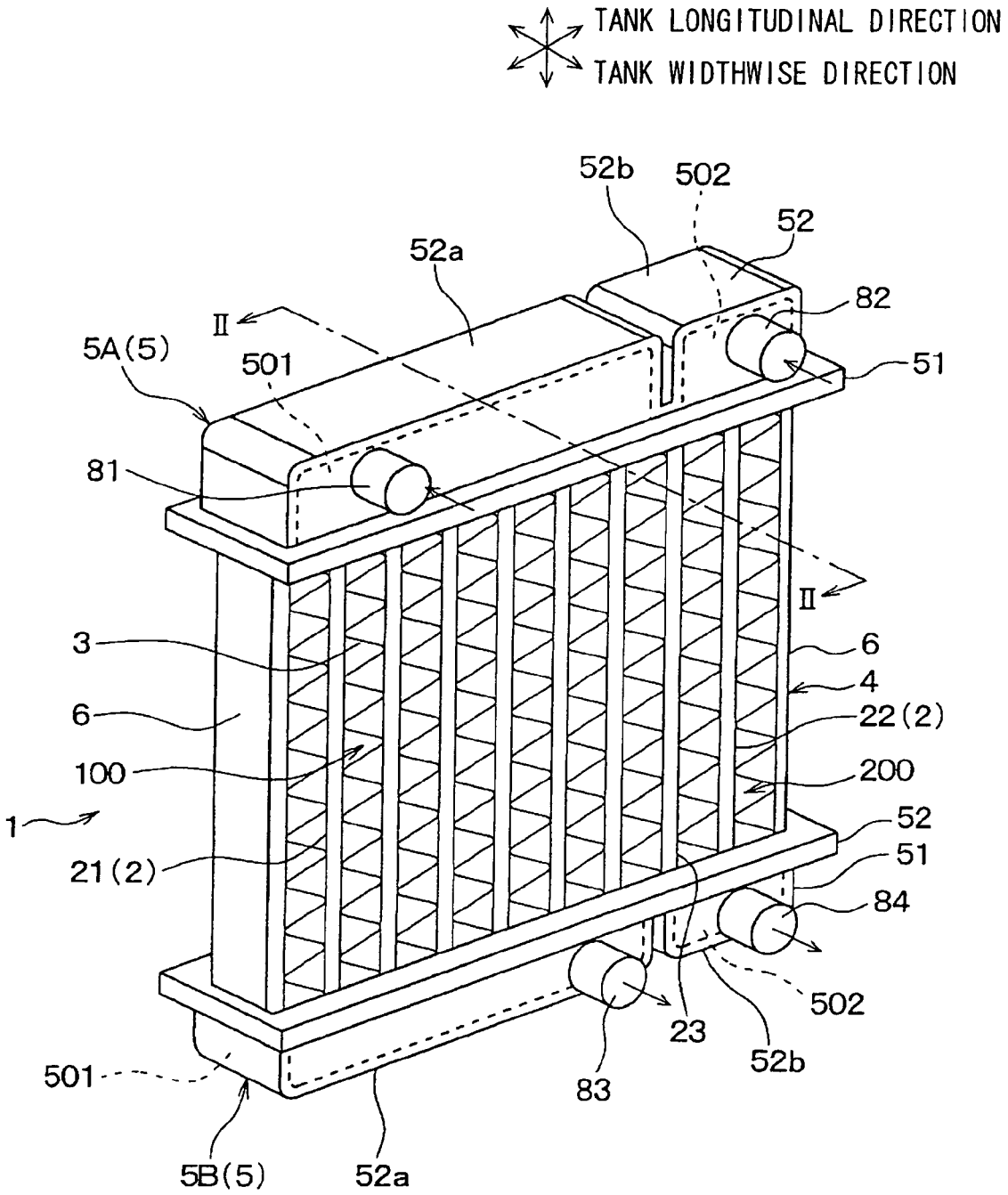
FIG. 1 is a perspective view illustrating a heat exchanger 1 of the first embodiment.

FIG. 1 is a perspective view illustrating a heat exchanger 1 of the first embodiment. As shown in FIG. 1, the heat exchanger 1 of the present embodiment has a core unit 4 and a pair of header tanks 5. The core unit 4 includes multiple tubes 2 and fins 3, and the pair of header tanks 5 is assembled on both end portions of the core unit 4.

The tubes 2 allow fluid to flow therethrough, and the tube 2 is formed to have a flat shape such that a direction of a longitudinal diameter of the tube 2 coincides with an air flow direction. Also, the multiple tubes 2 are arranged in parallel with each other in a horizontal direction such that longitudinal directions of the tubes 2 coincide with a vertical direction. The fins 3 are formed to be corrugated, and are bonded to flat surfaces of both ends of the tubes 2. The fins 3 increase a heat transfer area to air, and thereby enhancing heat exchange between air and fluid that flows through the tubes 2.

The header tanks 5 are positioned at both end portions of the tubes 2 in a longitudinal direction (hereinafter, referred to as a tube longitudinal direction) and extend in a direction orthogonal to the tube longitudinal direction such that the header tanks 5 are communicated with the multiple tubes 2. In the present embodiment, the header tanks 5 are provided at both vertical ends of the tubes 2, and extend in a horizontal direction to be communicated with the multiple tubes 2. The header tank 5 has a core plate 51 and a tank main body 52. The core plate 51 has the tubes 2 to be inserted thereinto in a bonded manner, and the tank main body 52, together with the core plate 51, defines a tank space.

Also, side plates 6 are provided on both end portions of the core unit 4 in a lamination direction, in which the tubes 2 are laminated on one another. The side plates 6 reinforce the core unit 4. The side plate 6 extends in a direction parallel to the tube longitudinal direction, and has both end portions connected to the header tanks 5.

The core unit 4 is divided into two segments at partitioning means 520*a*, 520*b* of the header tank 5. In the present embodiment, the core unit 4 includes a first radiator unit 100 (first core unit) and a second radiator unit 200 (second core unit). The first radiator unit 100 exchanges heat between air and engine coolant, which circulates within an engine (not shown) for cooling the engine, in order to cool the engine coolant. The second radiator unit 200 cools electrical system coolant that circulates within an electrical control circuit, which controls an electric motor, such as an electric motor (not shown) and an inverter circuit (not shown), such that the electrical system coolant cools the electric motor and the electrical control circuit.

In the above, the multiple tubes 2 include first tubes 21 and second tubes 22. The first tubes 21 constitute the first radiator unit 100 and allow the engine coolant to circulate therethrough. The second tubes 22 constitute the second radiator unit 200, and allow the electrical system coolant to circulate therethrough. It should be noted that the first radiator unit 100 and the second radiator unit 200 correspond to the present invention multiple heat exchanger units of the second tubes 22.

In the header tank 5, a dummy tube 23 is provided at a boundary between the first radiator unit 100 and the second radiator unit 200. In other words, the dummy tube 23 is provided between the first tubes 21 and the second tubes 22. The dummy tube 23 does not allow the engine coolant or the electrical system coolant to circulate therethrough. Although there is one dummy tube 23 in the present embodiment, two or more dummy tubes 23 may alternatively be provided.

Figure 2:
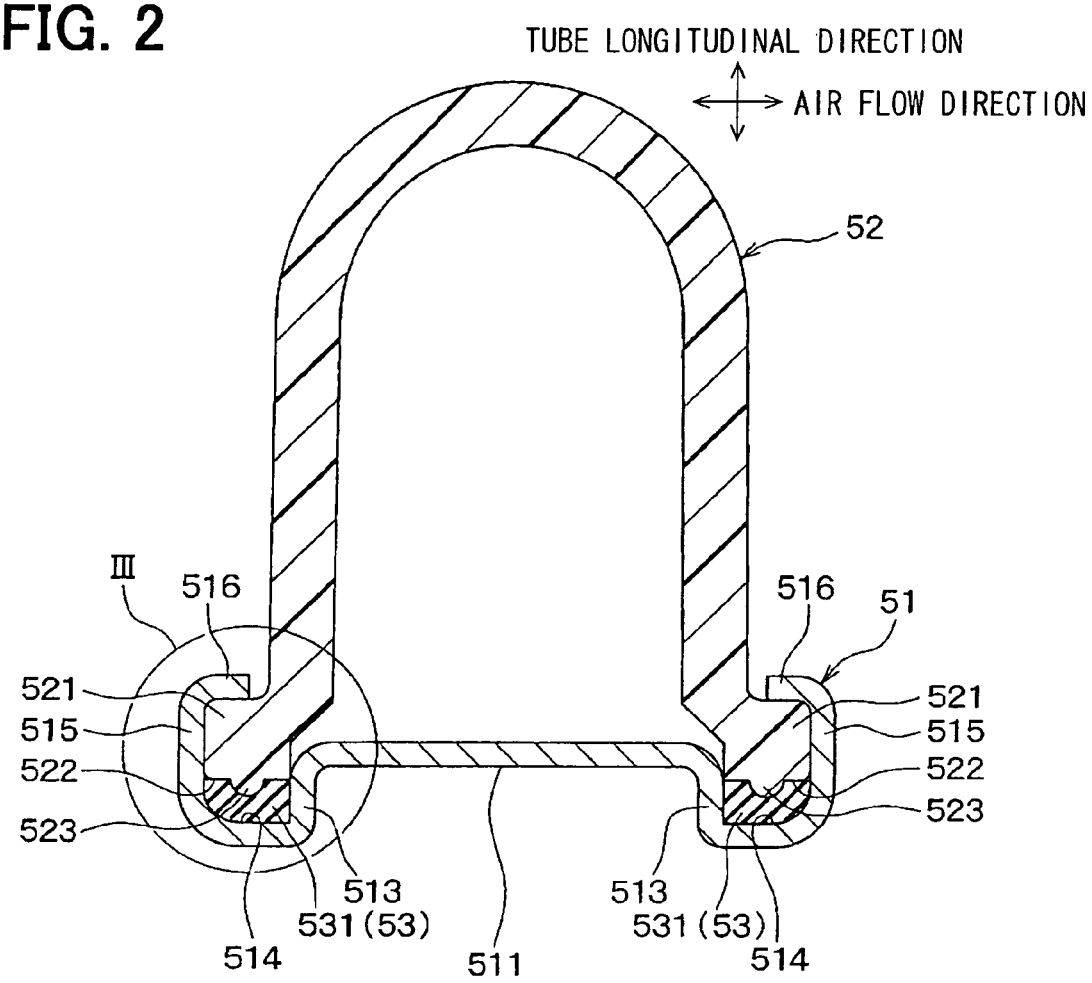
FIG. 2 is a cross-sectional view taken along line II-II in FIG. 1.
Figure 3:
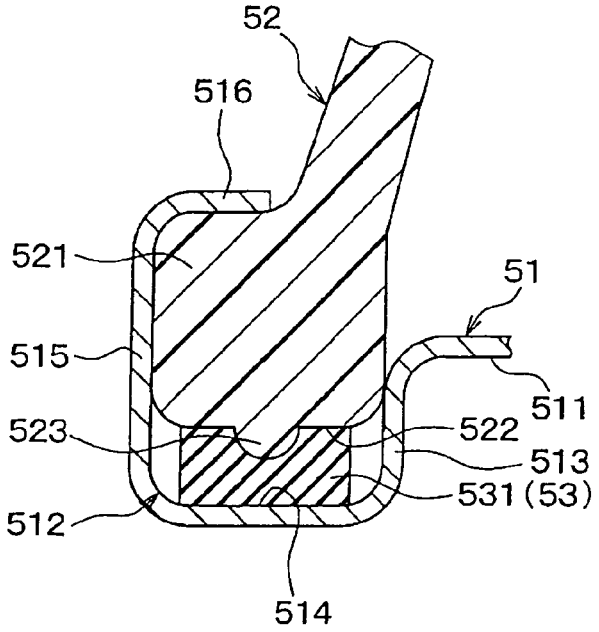
FIG. 3 is an enlarged view of a part III in FIG. 2.
Figure 4:
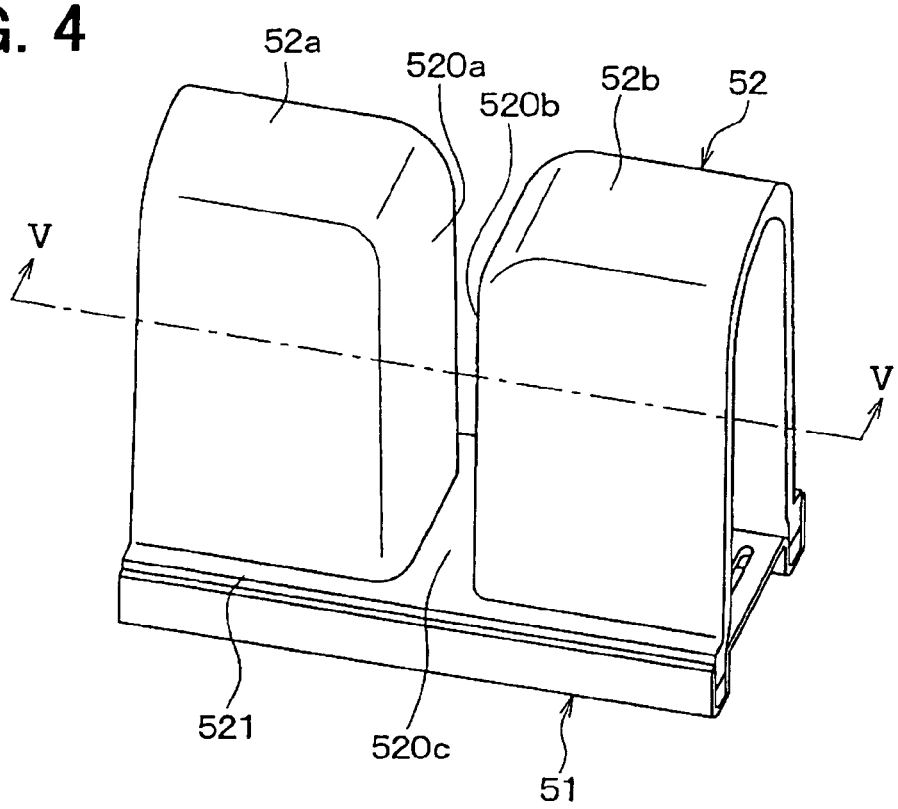
FIG. 4 is an enlarged perspective view illustrating a header tank 5 of the heat exchanger 1 according to the first embodiment.
Figure 5:
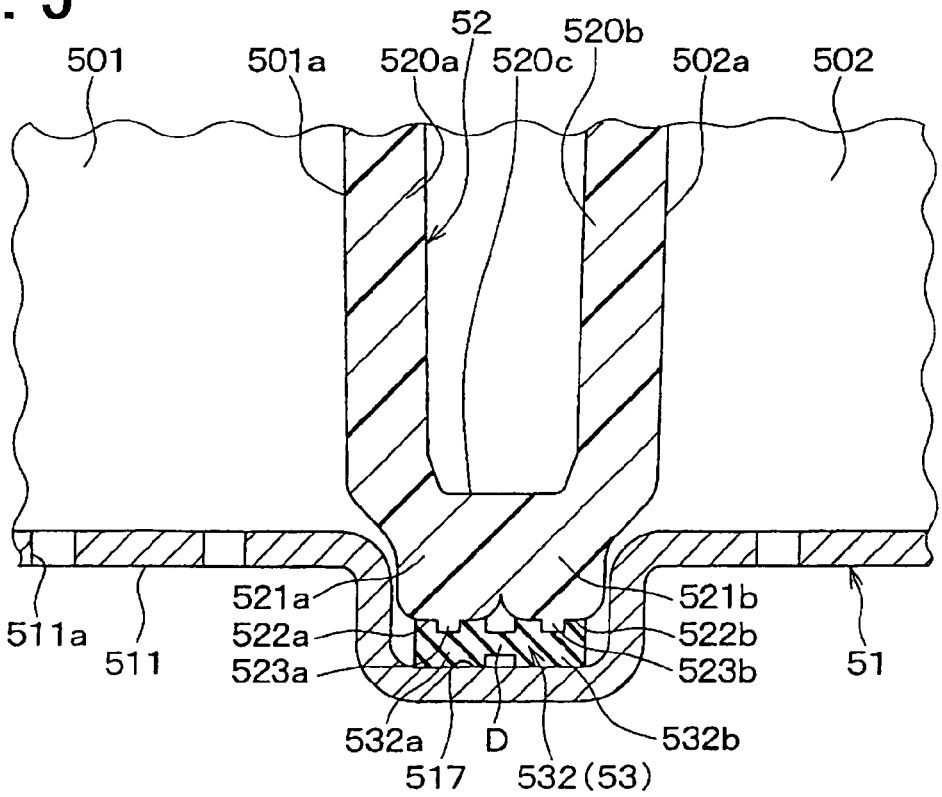
FIG. 5 is a cross-sectional view taken along line V-V in FIG. 4.

Next, details of the configuration of the header tank 5 will be described. FIG. 2 is a cross-sectional view taken along of line II-II in FIG. 1, and FIG. 3 is an enlarged view of a part III in FIG. 2. FIG. 4 is an enlarged perspective view illustrating a main part of the header tank 5 of the first embodiment. FIG. 5 is a cross-sectional view taken along line V-V in FIG. 4.

As shown in FIGS. 2 to 5, the header tank 5 includes the core plate 51, the tank main body 52, and a gasket 53. The core plate 51 receives therein the tubes 2 and side plates 6 in a bonded manner, and the tank main body 52 and the core plate 51 together define an in-tank space that is a space within the header tank 5. The gasket 53 serves as a seal member that seals between the core plate 51 and the tank main body 52.

Then, in the present embodiment, the core plate 51 is made of an aluminum alloy, and the tank main body 52 is made of a resin, such as glass-reinforced polyamide that is reinforced by glass fiber. In a state, where the gasket 53, which is made of a rubber, is held by the core plate 51 and the tank main body 52 therebetween, a protrusion part 516 of the core plate 51 is plastically deformed to be pressed against the tank main body 52, and then the tank main body 52 is crimped to the core plate 51 in a fixed manner.

The core plate 51 has a tube bonding surface 511, to which the tubes 2 are bonded. The tube bonding surface 511 has multiple tube insertion bores 511*a*, into which the tubes 2 are inserted and blazed, arranged in the tube lamination direction. Furthermore, the tube bonding surface 511 has side plate insertion bores (not shown), to which the side plates 6 are inserted and blazed, at both ends of the tube bonding surface 511 in the tube lamination direction. Also, the tube bonding surface 511 has a dummy tube insertion bore 511*c*, to which the dummy tube 23 is inserted and blazed.

An annular groove 512 is formed over an entire perimeter at the tube bonding surface 511, and receives therein the gasket 53 and an outer periphery projection portion 521, which is formed at an end portion of the tank main body 52 adjacent the core plate 51. The groove 512 is defined by three surfaces. In other words, the groove 512 is defined by a wall surface of an inner wall part 513, an outer peripheral seal surface 514, and a wall surface of an outer wall part 515. The inner wall part 513 is formed by bending an outer peripheral part of the tube bonding surface 511 in a direction perpendicular to the tube bonding surface 511, and the inner wall part 513 extends in the tube longitudinal direction. The outer peripheral seal surface 514 is formed by bending the inner wall part 513 in a direction perpendicular to the inner wall part 513, and the outer peripheral seal surface 514 extends in a direction perpendicular to the tube longitudinal direction. The outer wall part 515 is formed by bending the outer peripheral seal surface 514 in a direction perpendicular to the outer peripheral seal surface 514, and the outer wall part 515 extends in the tube longitudinal direction. Also, multiple protrusion parts 516 are formed at an end portion of the outer wall part 515.

In the present embodiment, the gasket 53 includes an annular part 531 and a partitioning seal part 532. The annular part 531 is formed into an annular shape that corresponds to the groove 512 of the core plate 51, and the partitioning seal part 532 is configured to seal between the core plate 51 and partitioning means, which will be described later. For example, the annular part 531 has a rounded rectangular ring shape. The partitioning seal part 532 extends from one position of the annular part 531 in a transverse direction of the rounded rectangular shape, and connects with the other position of the annular part 531 that opposed to the one position. As a result, the gasket 53 has a shape similar to θ (symbol: theta) formed by the annular part 531 and the partitioning seal part 532. The detailed configuration of the partitioning seal part 532 will be described later.

The tank main body 52 has an outer periphery projection portion 521 that is provided with a tank-side seal surface 522. The tank-side seal surface 522 is formed to have an annular shape that surrounds the in-tank space. Also, the tank-side seal surface 522 contacts the annular part 531 of the gasket 53 such that the tank-side seal surface 522 and the outer peripheral seal surface 514 of the core plate 51 hold the gasket 53 therebetween.

The tank-side seal surface 522 has a projection portion 523 that projects toward the annular part 531 of the gasket 53. The projection portion 523 is pressed against the gasket 53 such that the gasket 53 is compressed through elastic deformation. As a result, the position is stabilized, and also an appropriate compressibility ratio is secured.

The core plate 51 has a partitioning seal surface 517 that seals between the core plate 51 and partitioning means 520*a*, 520*b*, which will be described later. The partitioning seal part 532 of the gasket 53 is provided on the partitioning seal surface 517. Also, the partitioning seal surface 517 is positioned on a plane of the outer peripheral seal surface 514, or in other words, on a bottom surface of the groove 512. As a result, the partitioning seal surface 517 is formed continuously from the outer peripheral seal surface 514.

Also, the tank space of the header tank 5 is divided by the partitioning means 520*a*, 520*b* (described later) into a first space 501 and a second space 502 that are arranged in a tank longitudinal direction. Specifically, the tank main body 52 of the present embodiment is divided into a first main body segment 52*a* and a second main body segment 52*b*. The first main body segment 52*a*, together with the core plate 51, defines the first space 501, and the second main body segment 52*b*, together with the core plate 51, defines the second space 502. Thus, the first main body segment 52*a* and the second main body segment 52*b* are also arranged in the tank longitudinal direction.

In the present embodiment, the first main body segment 52*a* has a wall surface that is opposed to the second main body segment 52*b*, and the wall surface is referred to as a first opposed wall 520*a*. The second main body segment 52*b* has a wall surface that is opposed to the first main body segment 52*a*, and the wall surface is referred to as a second opposed wall 520*b*. Also, the first opposed wall 520*a* has an end portion adjacent the core plate 51, and the end portion is referred to as a first opposed wall end portion 521*a*. The second opposed wall 520*b* has an end portion adjacent the core plate 51, and the end portion is referred to as a second opposed wall end portion 521*b*.

The first opposed wall 520*a* has a first partitioning surface 501*a* that faces the first space 501. The second opposed wall 520*b* has a second partitioning surface 502*a* that faces the second space 502. The first opposed wall 520*a* has a surface opposite from the first partitioning surface 501*a*, and the opposite surface faces toward the exterior of the header tank 5. Also, the second opposed wall 520*b* has a surface opposite from the second partitioning surface 502*a*, and the opposite surface faces toward the exterior of the header tank 5. In other words, the first opposed wall 520*a* constitutes a part of an external wall surface of the first main body segment 52*a*, and the second opposed wall 520*b* constitutes a part of an external wall surface of the second main body segment 52*b*.

Here, in the heat exchanger 1 of the present embodiment, the first opposed wall 520*a* and the second opposed wall 520*b* partition a single main body segment of the header tank 5 (or the tank main body 52) into the first main body segment 52*a* and the second main body segment 52*b*. As a result, the first opposed wall 520*a* and the second opposed wall 520*b* constitute partitioning means of the present invention. Also, the first opposed wall 520*a* corresponds to a first partitioning part of the present invention, and the second opposed wall 520*b* corresponds to a second partitioning part of the present invention.

The first opposed wall end portion 521*a* and the second opposed wall end portion 521*b* have shapes similar to a shape of the outer periphery projection portion 521 of the tank main body 52. In other words, the first opposed wall end portion 521*a* and the second opposed wall end portion 521*b* respectively have opposed wall seal surfaces 522*a*, 522*b* that are opposed to the partitioning seal surface 517 of the core plate 51. Also, the opposed wall seal surfaces 522*a*, 522*b* contact the partitioning seal part 532 of the gasket 53 such that the opposed wall seal surfaces 522*a*, 522*b*, together with the partitioning seal surface 517 of the core plate 51, hold the gasket 53. Also, the opposed wall seal surfaces 522*a*, 522*b* respectively have projection portions 523*a*, 523*b* formed to project toward the partitioning seal part 532 of the gasket 53.

In the present embodiment, the first opposed wall 520*a* and the second opposed wall 520*b* are spaced apart from each other, and the first opposed wall 520*a* and the second opposed wall 520*b* are connected with each other at end portions thereof adjacent the core plate 51. In other words, the end portions of the first opposed wall 520*a* and the second opposed wall 520*b*, which end portions are located adjacent the core plate 51, form a connection part 520*c* that connects the first opposed wall 520*a* with the second opposed wall 520*b*. The connection part 520*c* contacts the partitioning seal part 532 of the gasket 53 such that the connection part 520*c*, together with the partitioning seal surface 517 of the core plate 51, holds the gasket 53 therein.

The partitioning seal part 532 of the gasket 53 of the present embodiment has a first seal part 532*a* and a second seal part 532*b*. The first seal part 532*a* seals between the first opposed wall 520*a* and the core plate 51, and the second seal part 532*b* seals between the second opposed wall 520*b* and the core plate 51. The first seal part 532*a* and the second seal part 532*b* are integrally formed. In other words, the gasket 53 has the partitioning seal part 532, which seals between the first opposed wall 520*a* and the core plate 51, and which also seals between the second opposed wall 520*b* and the core plate 51.

Also, in a state, where the gasket 53 of the present embodiment has not been assembled to the core plate 51, a part of the gasket 53, which is to be held by the core plate 51 and the tank main body 52 therebetween, has a uniform thickness. In other words, when the gasket 53 itself is focused, the part of the gasket 53, which is to be held by the core plate 51 and the tank main body 52 therebetween, has the uniform thickness. "The part held by the core plate 51 and the tank main body 52 therebetween" corresponds to a part that receives a compression force when crimped. That means that "the part held by the core plate 51 and the tank main body 52 therebetween" does not include a part indicated by D in FIG. 5, which does not receive compression force when crimped.

Continuing with FIG. 1, upper one the pair of header tanks 5, which is provided on an upper side, is referred to as an upper header tank 5A, and a lower one of the pair of header tanks 5, which is provided on a lower side, is referred to as a lower header tank 5B. The upper header tank 5A is communicated with the first space 501, and has an engine coolant inlet 81 and an electrical system coolant inlet 82. The engine coolant inlet 81 allows engine coolant to flow into the first space 501, and the electrical system coolant inlet 82 is communicated with the second space 502 to allow electrical system coolant to flow from the second space 502. The lower header tank 5B has an engine coolant exit 83 and an electrical system coolant exit 84. The engine coolant exit 83 is communicated with the first space 501, and allows engine coolant to exit from the first space 501. The electrical system coolant exit 84 is communicated with the second space 502, and allows electrical system coolant to exit from the second space 502.

The heat exchanger 1 of the present embodiment is configured as above. As a result, when the tank main body 52 is crimped to the core plate 51 in the fixed manner, the end portions of the partitioning means 520*a*, 520*b* adjacent the core plate 51 are forced to compress the partitioning seal part 532 of the gasket 53. Thereby, it is possible to seal between the partitioning means 520*a*, 520*b* and the partitioning seal surface 517 of the core plate 51.

In the above, because the partitioning seal surface 517 of the core plate 51 is positioned on a plane that is the same as a plane of the outer peripheral seal surface 514, it is possible to cause the partitioning means 520*a*, 520*b* to apply uniform compression force on an entire surface of the partitioning seal part 532 of the gasket 53. Due to the above, it is possible to reliably seal between the partitioning means 520*a*, 520*b* and the partitioning seal surface 517 of the core plate 51. As a result, it is possible to improve the sealing performance of the partitioning member of the header tank 5.

Figure 6:
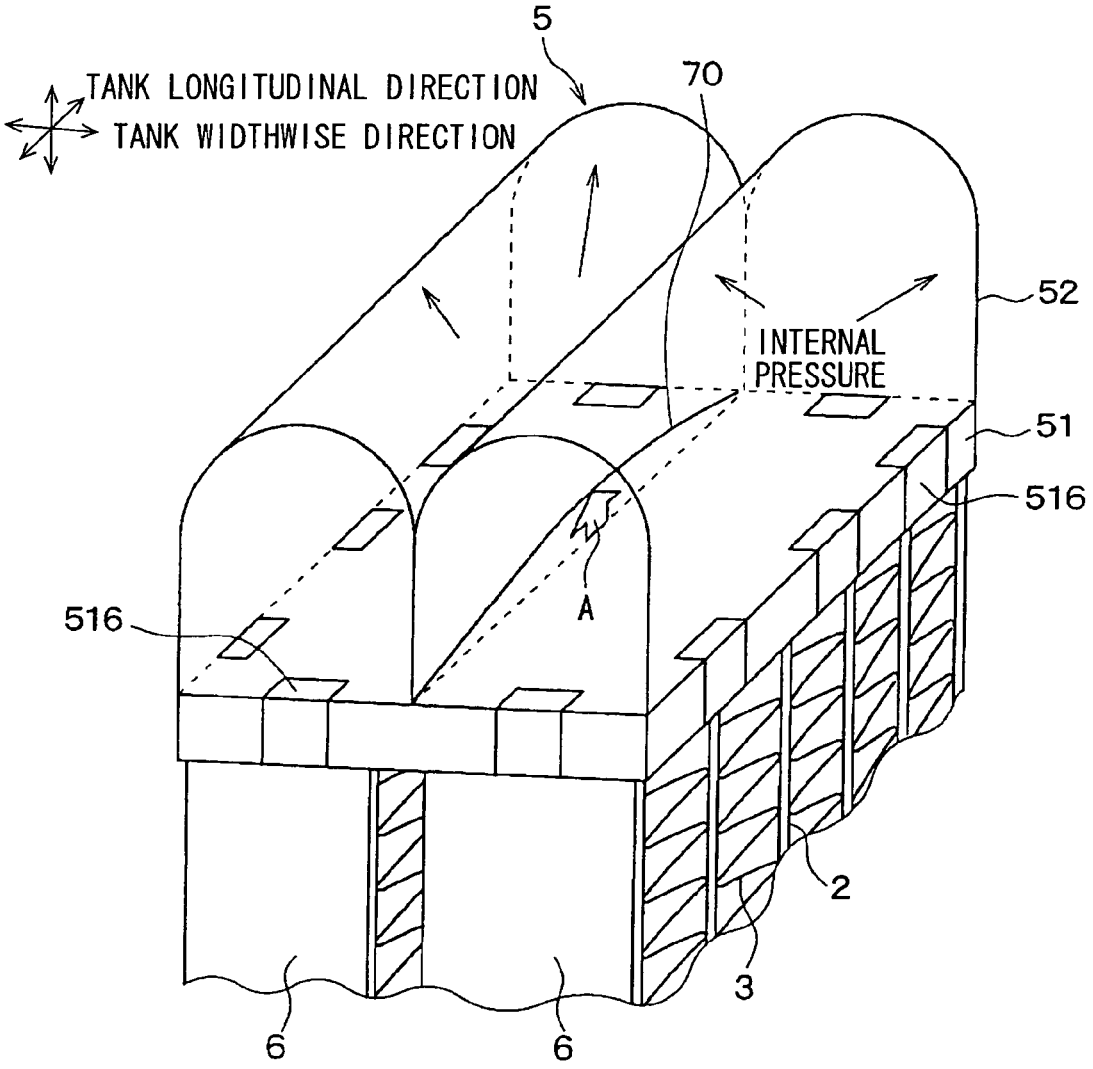
FIG. 6 is a perspective view illustrating a main part, of the heat exchanger of the first comparison example.

Also, FIG. 6 shows a heat exchanger of the first comparison example, in which the header tank 5 is divided in a widthwise direction. In other words, the header tank 5 in FIG. 6 is divided into a first space 501 and a second space 502 such that the first space 501 and the second space 502 are arranged in the widthwise direction of the header tank 5.

In the heat exchanger of the first comparison example, the header tank 5 has an outer peripheral part that is provided with protrusion parts 516. The protrusion part 516 serves as crimping means for crimping the tank main body 52 to the core plate 51 in a fixed manner. A partitioning part 70 is not provided with means, such as the crimping means, for limiting the header tank 5 from being moved away from the core plate 51 when the header tank 5 is applied with internal pressure. Furthermore, in the heat exchanger of the first comparison example, the header tank 5 is divided in the widthwise direction. In other words, the partitioning part 70 extends in the longitudinal direction of the header tank 5. As a result, a center section of the partitioning part 70 in the longitudinal direction of the header tank 5 is moved in a direction, as indicated by an arrow A of FIG. 6, for reducing the compression force of the gasket (not shown). Therefore, the sealing performance of the partitioning member of the header tank 5 may deteriorate disadvantageously.

In contrast, in the heat exchanger of the present embodiment, the header tank 5 is divided in the longitudinal direction. In other words, the header tank 5 is divided into the first space 501 and the second space 502 such that the first space 501 and the second space 502 are arranged in the longitudinal direction of the header tank 5. As a result, the partitioning means 520*a*, 520*b* extends in the widthwise direction of the header tank 5. Therefore, it is possible to make the dimension of the partitioning member of the header tank 5 shorter than that of the first comparison example. As a result, even when the header tank 5 is applied with internal pressure, it is possible to limit the partitioning means 520*a*, 520*b* from being moved in the direction for reducing the compression force of the gasket 53. As a result, it is possible to improve the sealing performance of the partitioning member of the header tank 5.

Figure 7:
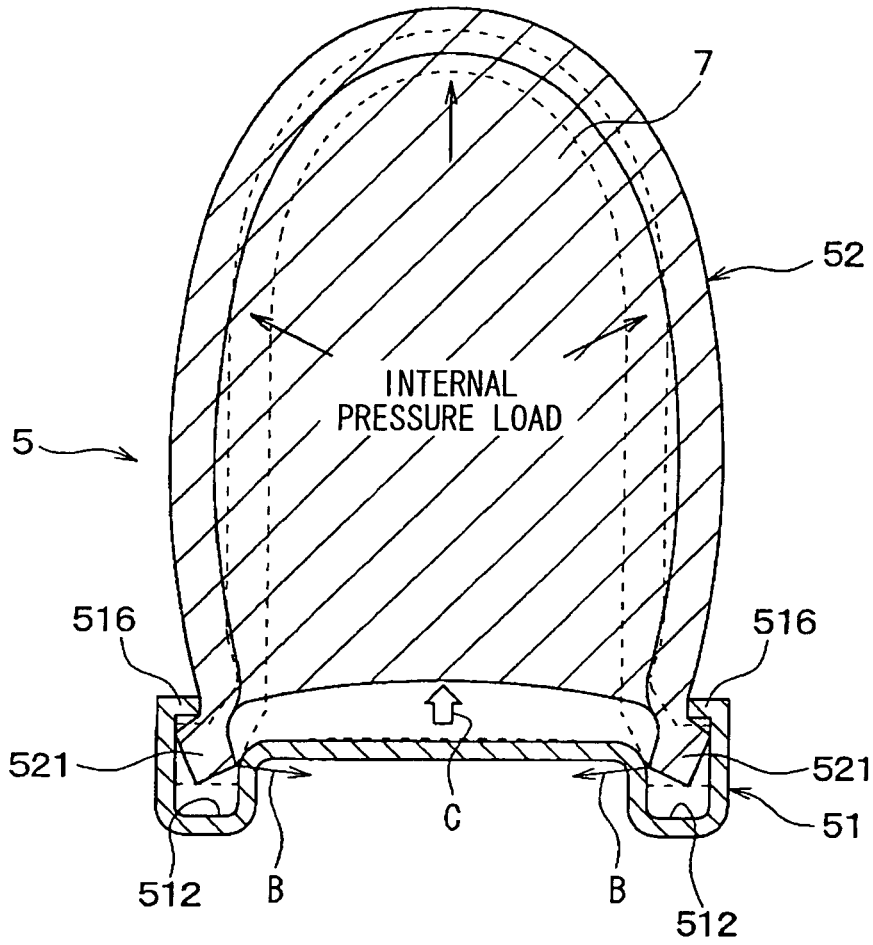
FIG. 7 is a cross-sectional view illustrating a header tank 5 of a heat exchanger according to the second comparison example.

Also, FIG. 7 shows a heat exchanger of the second comparison example, in which a partitioning seal surface 517 of a core plate 51 has a curved shape. A partition wall 7 having a plate shape is provided within a header tank 5 to extend in a direction orthogonal to the longitudinal direction of the header tank 5. An outer periphery projection portion 521, which is formed at an end portion of the tank main body 52 adjacent the core plate 51, is crimped to the core plate 51 through a gasket (not shown) in a fixed manner.

In the heat exchanger of the second comparison example, protrusion parts 516 are plastically deformed for fixation through crimping in a state, where the outer periphery projection portion 521 of the tank main body 52 is received within a groove 512 of the core plate 51. Thereby, when the header tank 5 is loaded with the internal pressure, the outer periphery projection portion 521 is deformed in an inward direction of the header tank 5 as indicated by an arrow B of FIG. 7. The above causes the partition wall 7 to be deformed in a direction, as indicated by an arrow C in FIG. 7, for reducing the compression force of a gasket (not shown). Therefore, the sealing performance of partitioning member of the header tank 5 may deteriorate disadvantageously.

Figure 8:
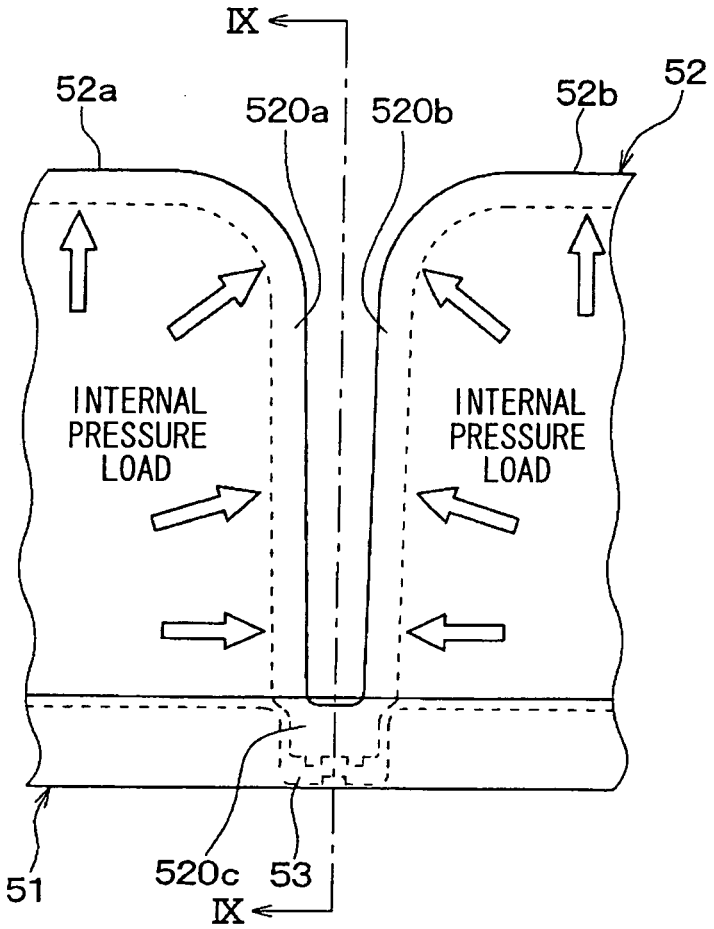
FIG. 8 is an enlarged front view illustrating the header tank 5 of the heat exchanger 1 according to the first embodiment.
Figure 9:
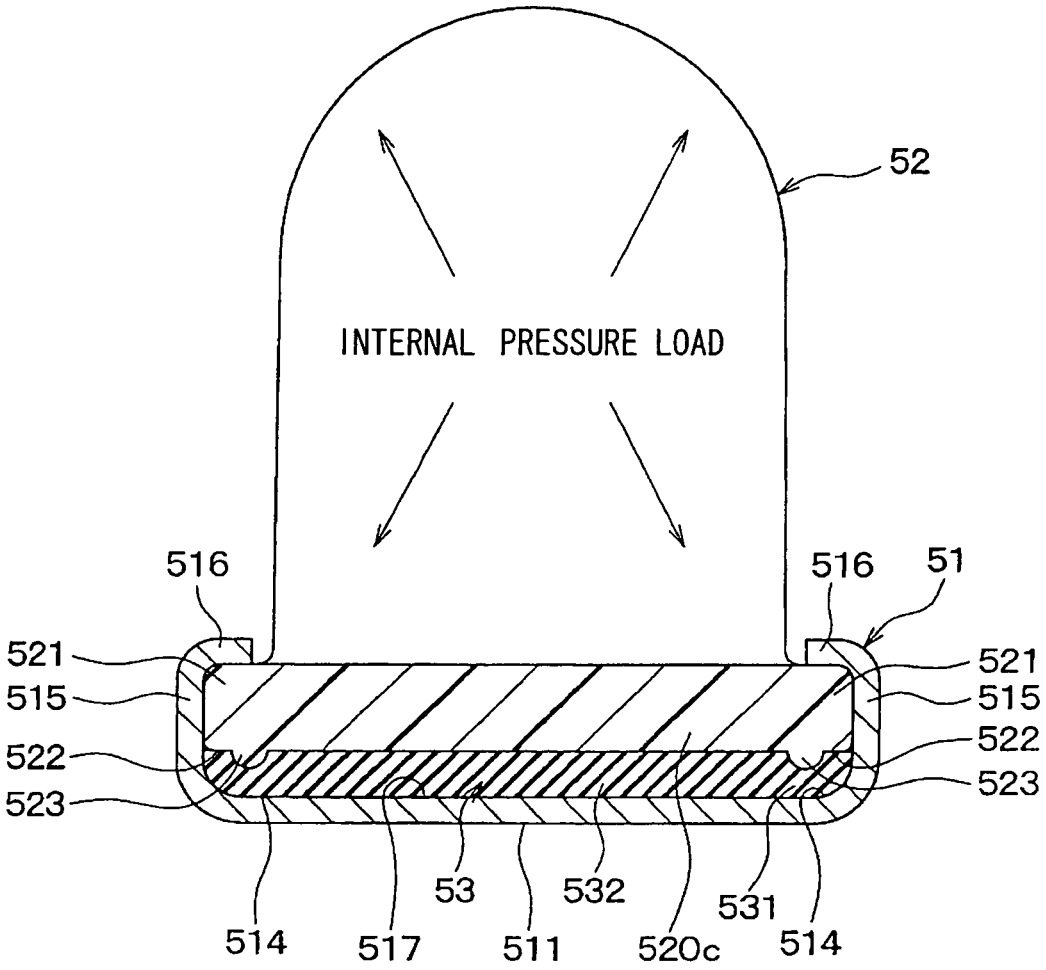
FIG. 9 is a cross-sectional view taken along line IX-IX in FIG. 8.

In contrast, in the heat exchanger of the present embodiment, as shown in FIGS. 8 and 9, the partitioning member of the header tank 5 (the connection part 520*c* of the partitioning means 520*a*, 520*b* in the present embodiment) extends in the widthwise direction of the header tank 5 such that the partitioning member of the header tank 5 provides connection between the outer periphery projection portions 521 of the tank main body 52. Also, the partitioning member of the header tank 5 is provided adjacent an opening portion of the tank main body 52 (or is provided to be opposed to the core plate 51). As a result, in a case, where the header tank 5 is loaded with the internal pressure, even if the force applied in the inward direction of the header tank 5 is loaded to the outer periphery projection portion 521 of the tank main body 52, it is possible to limit the outer periphery projection portion 521 from being deformed in the inward direction of the header tank 5 because the partitioning member of the header tank 5 provides connection between the outer periphery projection portions 521. Due to the above, it is possible to limit the partitioning member of the header tank 5 from moving in the direction for reducing the compression force of the gasket 53. As a result, it is possible to improve the sealing performance of the partitioning member of the header tank 5.

Furthermore, it is possible to improve rigidity of the partitioning member of the header tank 5 (the connection part 520*c*) in the present embodiment compared with the second comparison example. As a result, even when internal pressure of the header tank 5 becomes higher, it is possible to limit the partitioning means 520*a*, 520*b* from being deformed, and thereby it is possible to limit the generation of a gap between the core plate 51 and the partitioning means 520*a*, 520*b*. As a result, it is possible to reliably achieve the sealing performance of the partitioning member of the header tank 5.

Second Embodiment

Figure 10:
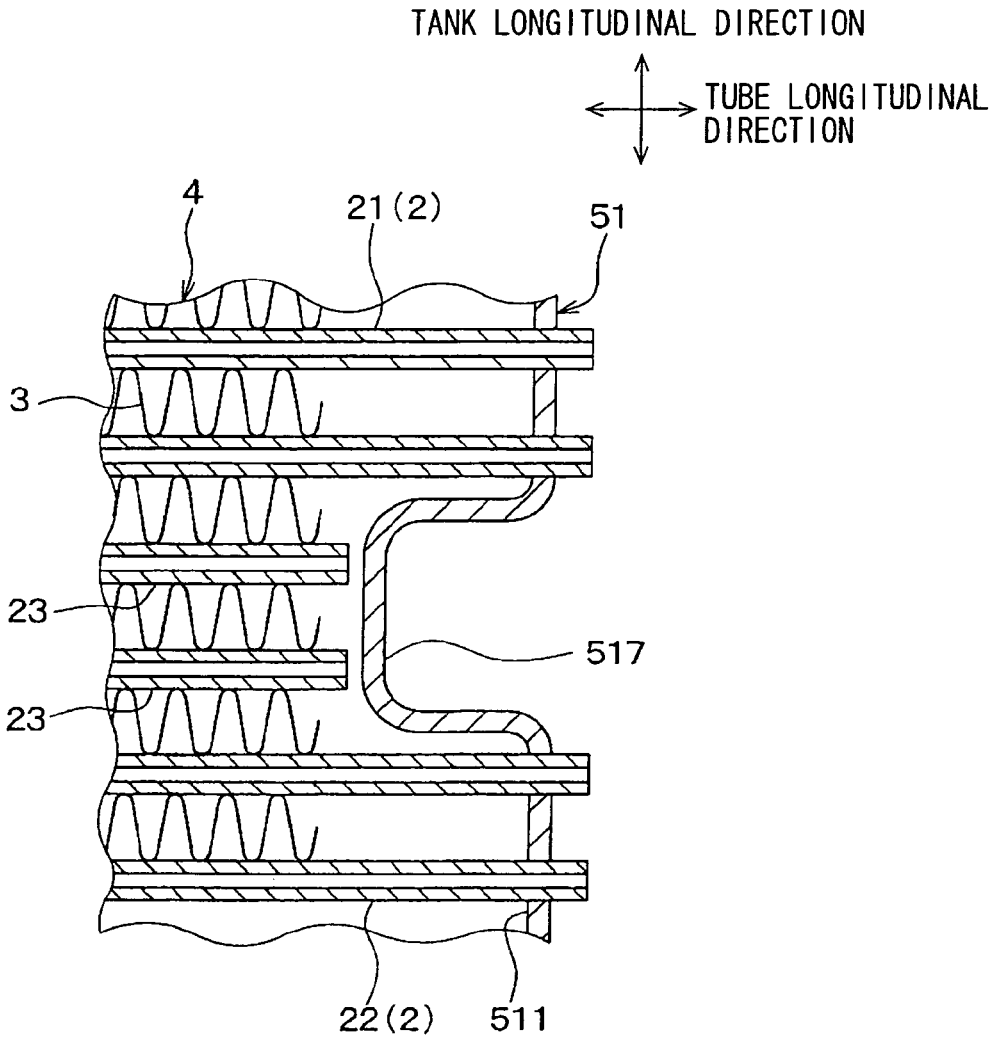
FIG. 10 is an enlarged sectional view illustrating a vicinity of dummy tubes 23 of a heat exchanger 1 according to the second embodiment.

Next, the second embodiment of the present invention will be described with reference to FIG. 10. FIG. 10 is an enlarged sectional view illustrating a vicinity of dummy tubes 23 of a heat exchanger 1 according to the present second embodiment.

As shown in FIG. 10, the partitioning seal surface 517 of the core plate 51 does not include holes, into which the dummy tubes 23 are inserted. Due to the above, the dummy tubes 23 remain not-inserted into the core plate 51, and thereby there is a clearance formed between the core plate 51 and a longitudinal end portion of the dummy tube 23. It should be noted that although there are two dummy tubes 23 in the present embodiment, there may be only one dummy tube 23. Also, there may be three or more dummy tubes 23.

Also, conventionally, at a bonding part between the core plate 51 and the dummy tube 23, residue of blazing may damage the partitioning seal surface 517 of the core plate 51, and thereby degrading sealing performance of sealing between the core plate 51 and the partition wall 7.

In contrast to the above, in the heat exchanger 1 of the present embodiment, because the dummy tubes 23 are not inserted into the core plate 51, it is possible to prevent the deposit of the residue of blazing on the partitioning seal surface 517 via the tubes 2. As a result, it, is possible to improve the sealing performance between the core plate 51 and the partition wall 7.

Furthermore, in the heat exchanger 1 of the present embodiment, because the dummy tubes 23 are not inserted into the core plate 51, it is possible to reduce a force for restricting thermal expansion/thermal contraction of the tubes 2 located at the vicinity of the partitioning seal surface 517. As a result, it is possible to reduce thermal stress generated at a connecting base part between the core plate 51 and the tubes 21, 22 located adjacent the partitioning means 520*a*, 520*b*.

Third Embodiment

Figure 11:
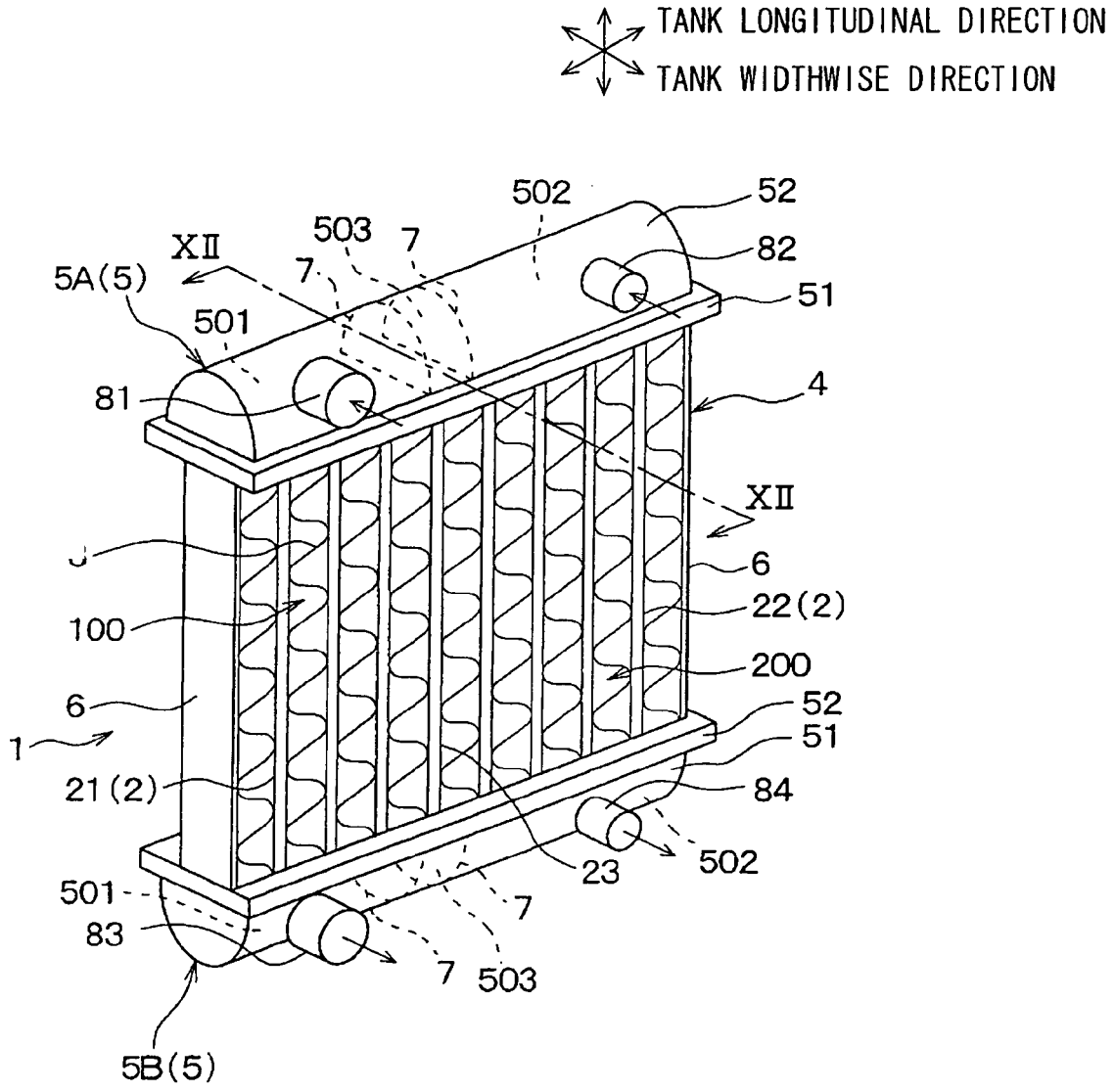
FIG. 11 is a perspective view illustrating a heat exchanger 1 according to the third embodiment.
Figure 12:
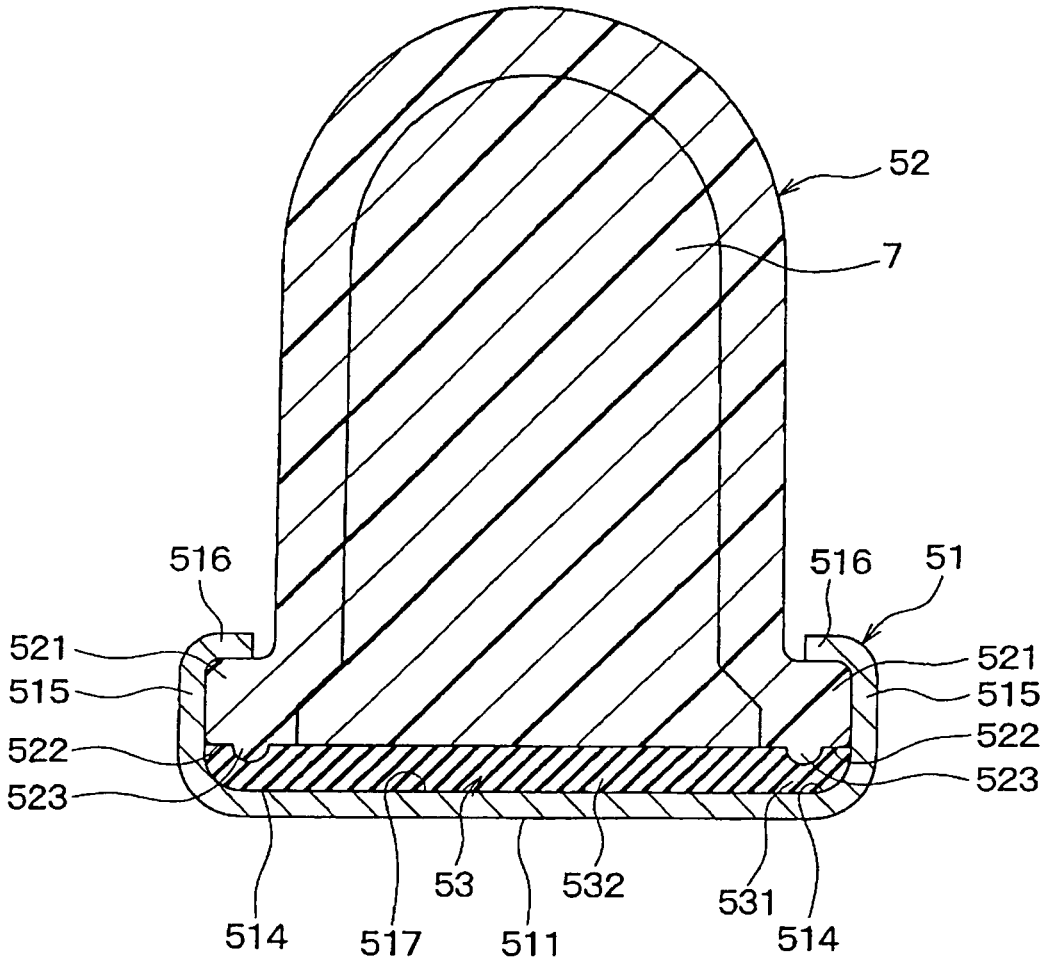
FIG. 12 is a cross-sectional view taken along line XII-XII in FIG. 11.

Next, the third embodiment of the present invention will be described with reference to FIGS. 11 to 14. FIG. 11 is a perspective view illustrating a heat exchanger 1 of the present third embodiment, FIG. 12 is a cross-sectional view taken along a line XII-XII in FIG. 11, FIG. 13 is an exploded perspective view illustrating a header tank 5 of the heat exchanger 1 of the present third embodiment, and FIG. 14 is an exploded perspective view illustrating a main part in FIG. 13.

As shown in FIGS. 11 to 14, in the heat exchanger 1 of the present embodiment, two partition walls 7 are provided within the header tank 5 at a boundary between the first radiator unit 100 and the second radiator unit 200 in order to divide the in-tank space in a tube longitudinal direction. In other words, the two partition walls 7 are provided between the first tubes 21 and the second tubes 22. Also, the two partition walls 7 are arranged at predetermined intervals. Due to the above, the in-tank space within the header tank 5 is delimited by the two partition walls 7 and thereby is divided into three segments in the longitudinal direction of the header tank 5.

In the present embodiment, one of the three segments of the in-tank space divided by the two partition walls 7 is communicated with the first tubes 21, and is referred to as the first space 501. Another one of the three segments is communicated with the second tubes 22, and is referred to as the second space 502. Also, the other one of the three segments is provided between the first space 501 and the second space 502, and is a third space 503 that is not communicated with either one of the first and second tubes 21, 22. Because the third space 503 is not communicated with the first and second tubes 21, 22, the third space 503 serves as a thermal insulating space. Also, one of the two partition walls 7 has the first partitioning surface 501*a* that is opposed to the first space 501, and the other partition wall 7 has the second partitioning surface 502*a* that is opposed to the second space 502.

Figure 13:
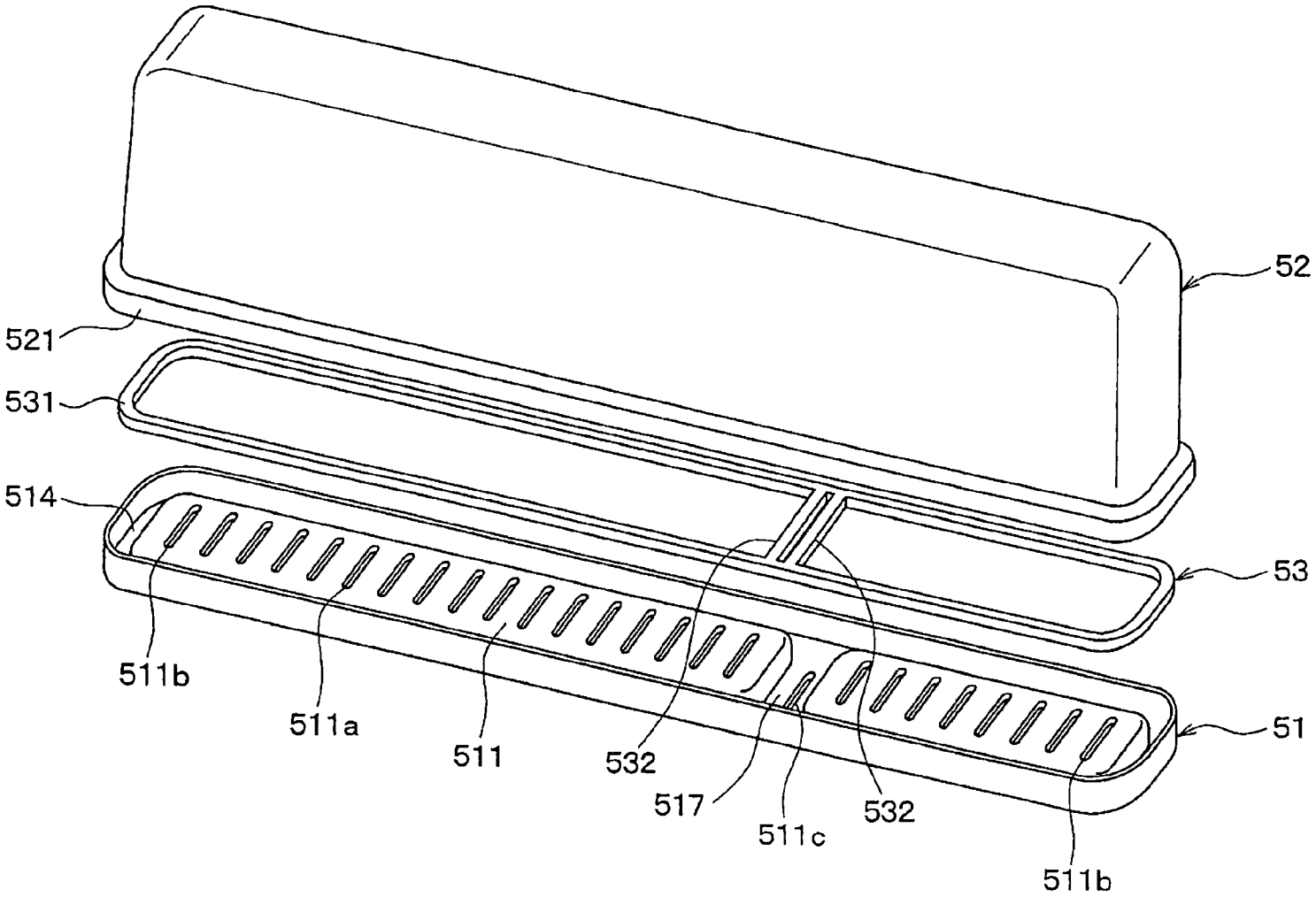
FIG. 13 is an exploded perspective view illustrating a header tank 5 of the heat exchanger 1 according to the third embodiment.
Figure 14:
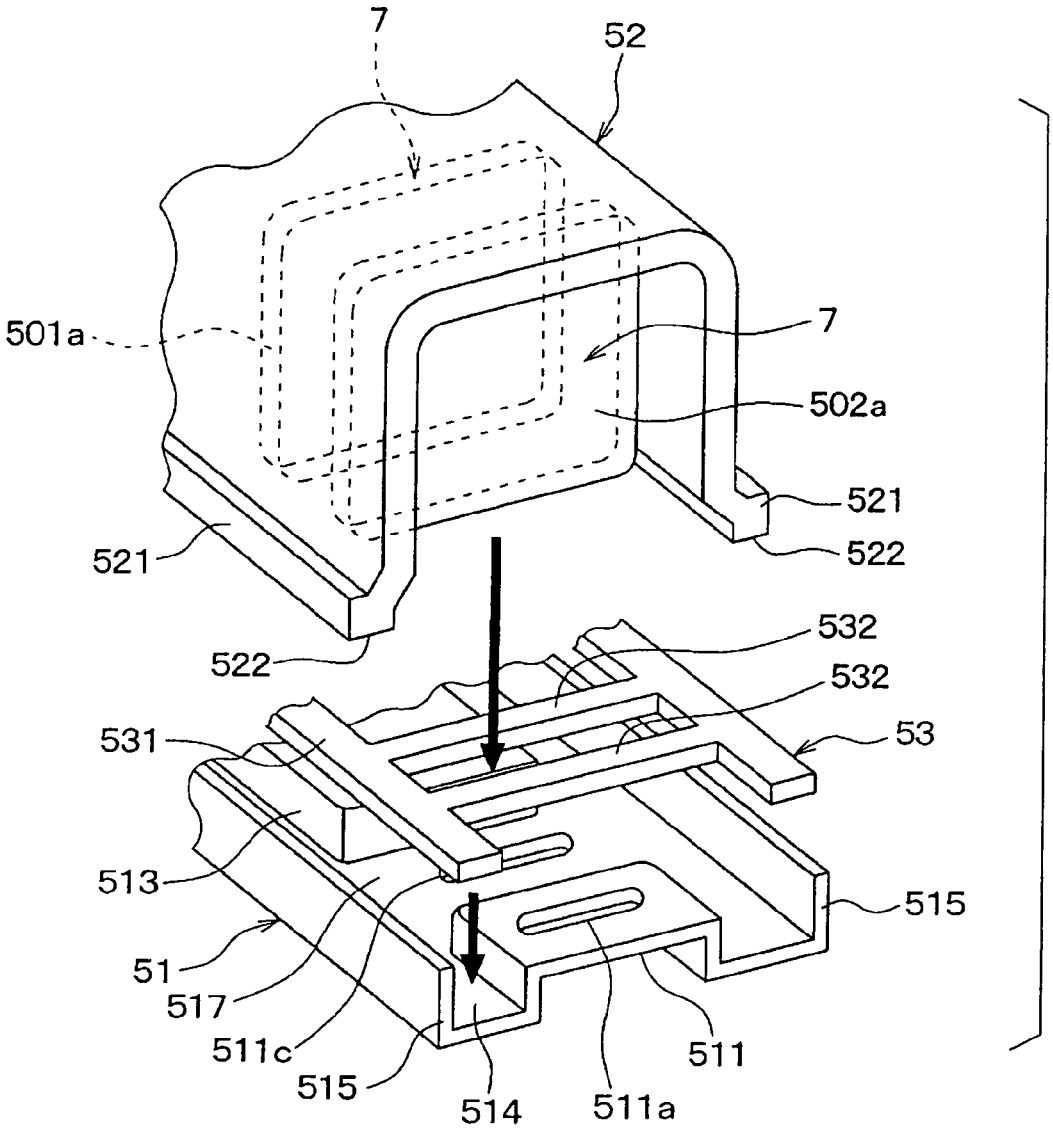
FIG. 14 is an exploded perspective view illustrating a main part in FIG. 13.

In the present embodiment, as shown in FIG. 13, the partitioning seal parts 532 of the gasket 53 have a longitudinal axis that extends in parallel to an air flow direction. In other words, the partitioning seal parts 532 extend in parallel to a longitudinal direction of the dummy tube insertion bore 511*c*. In the present embodiment, there are two partitioning seal parts 532. The two partitioning seal parts 532 are spaced apart from each other such that the dummy tube insertion bore 511*c* is located between the two partitioning seal parts 532. In the present embodiment, the two partitioning seal parts 532 are formed integrally with the annular part 531.

Because the heat exchanger 1 of the present embodiment is configured as above, the end portions of the partition walls 7 adjacent the core plate 51 compress the partitioning seal parts 532 of the gasket 53 when the tank main body 52 is crimped to the core plate 51 in a fixed manner. As a result, it is possible to seal between the partition walls 7 and the partitioning seal surface 517 of the core plate 51.

In the above time, the partitioning seal surface 517 of the core plate 51 is positioned on a plane the same as a plane, on which the outer peripheral seal surface 514 is positioned. As a result, it is possible to apply uniform compression force, by the partition walls 7, to the entire surface of the partitioning seal parts 532 of the gasket 53. Due to the above, it is possible to reliably seals between the partition walls 7 and the partitioning seal surface 517 of the core plate 51. As a result, it is possible to improve the sealing performance of the partitioning member of the header tank 5.

Also, fluid circulating through the first tubes 21 has temperature that is different from temperature of fluid circulating through the second tubes 22. Thereby, a difference of thermal expansion amounts of the tubes 21, 22 may be caused by a temperature difference between the tubes 21, 22 that are located adjacent the partition walls 7. Then, the above difference of the thermal expansion amounts may generate thermal stress, which occurs with thermal strain, to the connecting base part (bonding part) between the core plate 51 and the tubes 21, 22 adjacent the partition walls 7.

In contrast to the above, in the heat exchanger 1 of the present embodiment, because the partitioning seal surface 517 of the core plate 51 is positioned on the plane that is the same as the plane of the outer peripheral seal surface 514, the partitioning seal surface 517 is formed into a plane that is perpendicular to the tube longitudinal direction. As a result, it is possible to reduce the rigidity of the partitioning seal surface 517, and thereby reducing the force for restricting the thermal expansion/thermal contraction of the tubes 2 in the vicinity of the partitioning seal surface 517. As a result, because the vicinity of the partitioning seal surface 517 of the core plate 51 is deformable to absorb the thermal expansion difference between the tubes 21, 22 adjacent the partition walls 7, it is possible to reduce the thermal stress generated at the connecting base part between the core plate 51 and the tubes 21, 22 adjacent the partition walls 7.

Furthermore, in the heat exchanger 1 of the present embodiment, there are two partition walls 7, the in-tank space of the header tank 5 is divided into the first space 501, which is communicated with the first tubes 21, the second space 502, which is communicated with the second tubes 22, and the third space 503, which is provided between the first space 501 and the second space 502, and which is not communicated with either of the first and second tubes 21, 22. As a result, even in case of failure in sealing between the partition walls 7 and the core plate 51, coolant leaking from the first space 501 (or from the second space 502) would stay in the third space 503, and thereby the coolant is prevented from flowing to the exterior of the header tank 5. As a result, it is possible to prevent coolant from leaking from the header tank 5 to the exterior.

Fourth Embodiment

Figure 15:
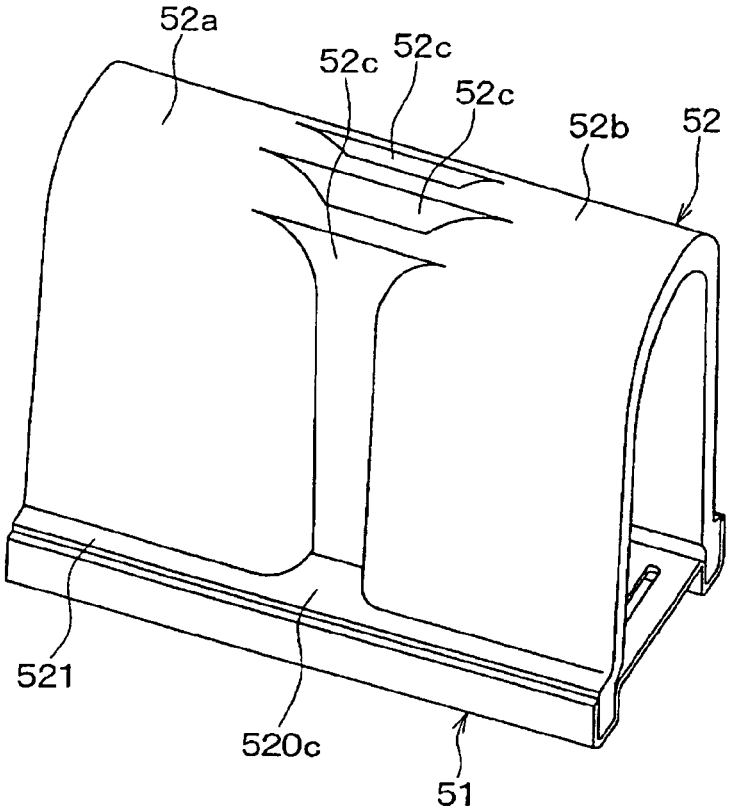
FIG. 15 is an enlarged perspective view illustrating a header tank 5 of a heat exchanger 1 according to the fourth embodiment.

Next, the fourth embodiment of the present invention will be described with reference to FIG. 15. FIG. 15 is an enlarged perspective view illustrating a header tank 5 of a heat exchanger 1 according to the present fourth embodiment.

As shown in FIG. 15, the header tank 5 of the present embodiment is provided between the first main body segment 52*a* and the second main body segment 52*b*, and has ribs 52*c* that connect the first main body segment 52*a* with the second main body segment 52*b*. Each of the ribs 52*c* has a plate shape that extends in a direction orthogonal to the air flow direction. The rib 52*c* extends from distal end portions of the first main body segment 52*a* and the second main body segment 52*b*, which are remote from the core plate 51, to proximal end portions of the first main body segment 52*a* and the second main body segment 52*b*, which are adjacent the core plate 51. The rib 52*c* is formed, integrally with the first main body segment 52*a* and the second main body segment 52*b*. In the present embodiment, there are three ribs 52*c* arranged in a direction parallel to the air flow direction. However, needless to say that a single rib 52*c* may be alternatively provided, or two ribs 52*c* may be alternatively provided. Alternatively, four or more ribs 52*c* may be provided.

In the heat exchanger 1 of the present embodiment, because the ribs 52*c* are provided between the first main body segment 52*a* and the second main body segment 52*b*, it is possible to limit blowing air from flowing through the gap between the first main body segment 52*a* and the second main body segment 52*b*, and thereby limiting the deterioration of heat exchange performance. Furthermore, because the rib 52*c* is provided between the first main body segment 52*a* and the second main body segment 52*b*, it is possible to prevent a warp of the tank main body 52, or in other words the warp of the first main body segment 52*a* and the second main body segment 52*b*, during the forming thereof. Also, simultaneously, it is possible to improve the workability of assembling the header tank 5 because the rigidity of the tank main body 52 is made high.

Fifth Embodiment

Figure 16:
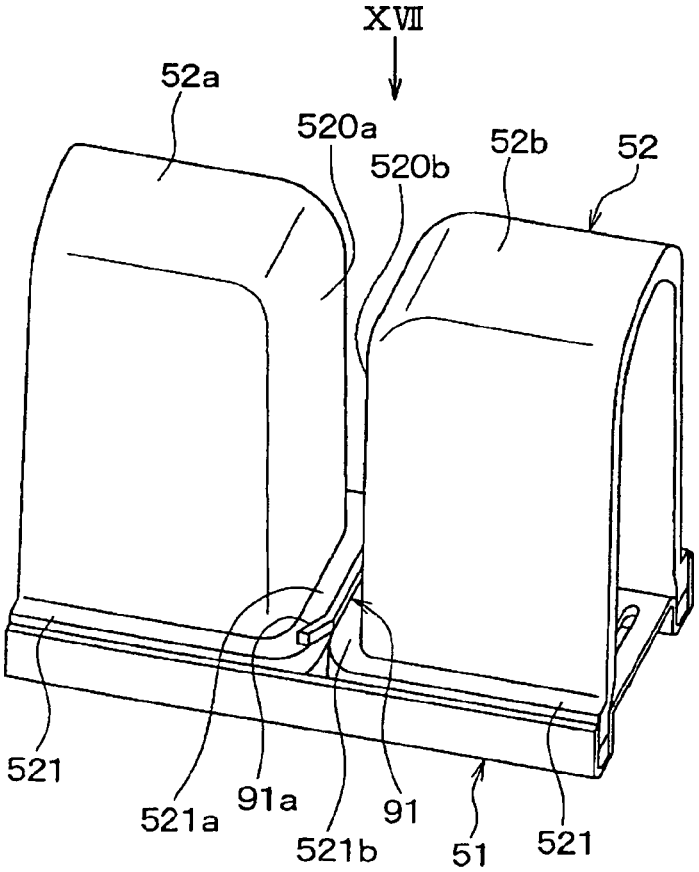
FIG. 16 is an enlarged perspective view illustrating a header tank 5 of a heat exchanger 1 of the fifth embodiment.

Next, the fifth embodiment of the present invention will be described with reference to FIGS. 16 and 17. FIG. 16 is an enlarged perspective view illustrating a header tank 5 of a heat exchanger 1 of the present fifth embodiment, and FIG. 17 is a view observed in a direction XVII in FIG. 16.

Figure 17:
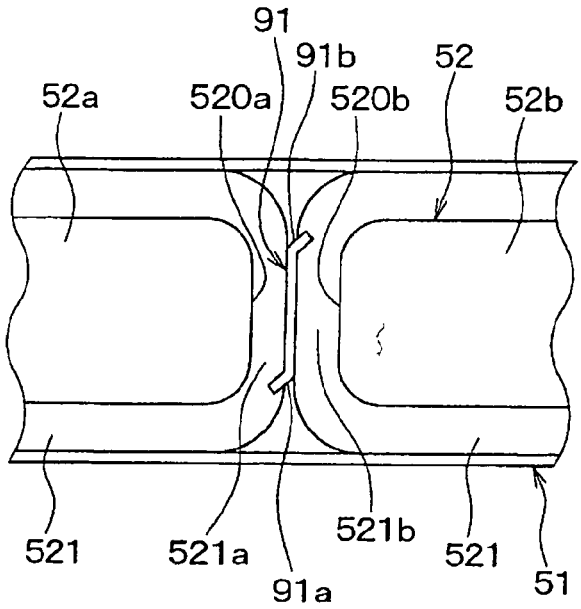
FIG. 17 is a view observed in a direction XVII in FIG. 16.

As shown in FIGS. 16 and 17, the first main body segment 52*a* and the second main body segment 52*b* of the present embodiment are formed separately from each other. Also, the first main body segment 52*a* and the second main body segment 52*b* are spaced apart from each other. A crimp plate 91 having a plate shape is provided between the first main body segment 52*a* and the second main body segment 52*b*.

The crimp plate 91 is received within a plate insertion bore (not shown) formed at the partitioning seal surface 517 of the core plate 51. It should be noted that the plate insertion bore may employ the dummy tube insertion bore 511*c* if the dummy tube insertion bore 511*c* (see FIG. 4) is formed at the core plate 51. In other words, the crimp plate 91 may be configured to be received within the dummy tube insertion bore 511*c*.

The crimp plate 91 has a plane that is generally orthogonal to the tube lamination direction. In other words, the plane of the crimp plate 91 is generally orthogonal to the longitudinal direction of the header tank 5. The crimp plate 91 has a distal end portion remote from the partitioning seal surface 517, and the distal end portion has a generally T shape having two projection portions 91*a*, 91*b* when observed in the tube lamination direction. The projection portions 91*a*, 91*b* project toward the upstream side and the downstream side of the air flow direction. The two projection portions 91*a*, 91*b* are bent to be angled relative to the air flow direction when observed in the tube longitudinal direction. One projection portion 91*a* of the two projection portions 91*a*, 91*b* has a surface adjacent the core plate 51, which surface contacts the first opposed wall end portion 521*a* of the first main body segment 52*a*. The other projection portion 91*b* has a surface adjacent the core plate 51, which contacts the second opposed wall end portion 521*b* of the second main body segment 52*b*.

Next, a method of manufacturing the header tank 5 of the heat exchanger 1 of the present embodiment will be described. Firstly, the crimp plate 91 is inserted into the plate insertion bore (not shown) of the core plate 51, and the crimp plate 91 is fixed to the core plate 51. In the above, the two projection portions 91*a*, 91*b* of the crimp plate 91 have not been bent, but are positioned on the common plane.

Next, after the first main body segment 52*a* and the second main body segment 52*b* are assembled to the core plate 51, the two projection portions 91*a*, 91*b* of the crimp plate 91 are twisted in the opposite directions from each other. Due to the above, the first opposed wall end portion 521*a* of the first main body segment 52*a* and the second opposed wall end portion 521*b* of the second main body segment 52*b* are crimped to the core plate 51 in the fixed manner.

In the heat exchanger 1 of the present embodiment, because there is provided the crimp plate 91 that fixedly crimps the first opposed wall end portion 521*a* of the first main body segment 52*a* and the second opposed wall end portion 521*b* of the second main body segment 52*b*, the first opposed wall end portion 521*a* and the second opposed wall end portion 521*b* are capable of providing greater compression force to the partitioning seal part 532 of the gasket 53. Due to the above, it is possible to reliably seals between the partitioning seal surface 517 of the core plate 51 and the first and second opposed wall end portions 521*a*, 521*b*. In other words, it is possible to reliably seal between partitioning means for partitioning the header tank 5 and the partitioning seal surface 517 of the core plate 51. As a result, it is possible to reliably improve the sealing performance of the partitioning member of the header tank 5.

Sixth Embodiment

Next, the sixth embodiment of the present invention will be described with reference to FIGS. 18 to 20. FIG. 18 is an enlarged perspective view illustrating a core plate 51 and a gasket 53 of a heat exchanger 1 of the present sixth embodiment, and FIG. 19 is an enlarged sectional view illustrating a main part of the header tank 5 of the present sixth embodiment.

As shown in FIGS. 18 and 19, the gasket 53 of the present embodiment has a first gasket part 53*a*, a second gasket part 53*b*, and a connection gasket part 53*c*. The first gasket part 53*a* seals between the first main body segment 52*a* and the core plate 51. The second gasket part 53*b* seals between the second main body segment 52*b* and the core plate 51, and the connection gasket part 53*c* connects the first gasket part 53*a* with the second gasket part 53*b*. The first gasket part 53*a*, the second gasket part 53*b*, and the connection gasket part 53*c* are integrally formed.

The partitioning seal part 532 is constituted by a part of the first gasket part 53*a*, a part of the second gasket part 53*b*, and the connection gasket part 53*c*. The part of the first gasket part 53*a* and the part of the second gasket part 53*b* are arranged on the partitioning seal surface 517 of the core plate 51.

In the present embodiment, the first gasket part 53*a* and the second gasket part 53*b* has corner portions each having an arc shape (so-called a rounded shape) of a predetermined radius. Also, the connection gasket part 53*c* is configured to connect the first gasket part 53*a* with the second gasket part 53*b* over an almost entire length in the air flow direction.

The connection gasket part 53*c* has one surface 531*c* and the other surface 532*c*. The one surface 531*c* is located to face the partitioning seal surface 517 of the core plate 51, and the other surface 532*c* is located on a side of the connection gasket part 53*c* opposite from the one surface 531*c*. A part of the one surface 531*c* of the connection gasket part 53*c* is recessed toward the other surface 532*c* to form a first recess 533*c*. Also, a part of the other surface 532*c* of the connection gasket part 53*c* is recessed toward the one surface 531*c* to form a second recess 534*c*. As above, the recesses 533*c*, 534*c* are formed to extend over the entire length of the connection gasket part 53*c* in the air flow direction.

Also, usually, after the manufacture of a heat exchanger having integrated multiple heat exchanger units, quality inspection is carried out to inspect the generation of a so-called internal leakage and a so-called external leakage. In the internal leakage, fluid circulates between the multiple heat exchanger units, and in the external leakage, fluid leaks to the exterior of the heat exchanger. In the quality inspection, gas used for inspection (hereinafter referred to as inspection gas) is actually circulated in the heat exchanger in order to detect the internal leakage and the external leakage.

During the above quality inspection process of the heat exchanger 1 of the present embodiment, when the sealing between the partition wall 7 and the core plate 51 has failure, as shown by an arrow in FIG. 19, inspection-used gas in the first space 501 and inspection-used gas in the second space 502 flows through the gap between the partitioning seal surface 517 of the core plate 51 and the gasket 53 to move into the first recess 533*c* formed at the gasket 53. Subsequently, inspection-used gas in the first space 501 and inspection-used gas in the second space 502 leak to the exterior of the header tank 5. In other words, the heat exchanger 1 is configured such that inspection-used gas always leaks to the exterior of the heat exchanger 1 if the internal leakage occurs to the heat exchanger 1 during the quality inspection of the heat exchanger 1 of the present embodiment. Thereby, it is possible to detect the occurrence of the internal leakage at an earlier stage.

In the present embodiment, FIG. 20 shows the third comparison example. In a heat exchanger that is not provided with a recess at the connection gasket part 53*c* of the gasket 53, when the sealing between the partition wall 7 and the core plate 51 has failure during the quality inspection process, the inspection-used gas in the first space 501 moves to the second space 502, and simultaneously the inspection-used gas in the second space 502 moves to the first space 501 as shown by an arrow in FIG. 20. In other words, during the quality inspection, even when the internal leakage occurs in the heat exchanger 1, it is impossible to detect the internal leakage as the external leakage. As a result, the inspection-used gas is required to be circulated within each of the heat exchanger units in order to detect the internal leakage.

In contrast to the above, the heat exchanger 1 of the present embodiment is configured such that the inspection-used gas always leaks to the exterior of the heat exchanger 1 even when the internal leakage occurs during the quality inspection. As a result, the external leakage and the internal leakage are detectable in the single inspection by, for example, connecting the engine coolant exit 83 with the electrical system coolant inlet 82 through a pipe, and simultaneously by introducing the inspection-used gas through the engine coolant inlet 81. As a result, it is possible to realize the quality inspection by a simple method, and thereby it is possible to improve the productivity.

Seventh Embodiment

Next, the seventh embodiment of the present invention will be described with reference to FIGS. 21 and 22. FIG. 21 is an enlarged perspective view illustrating a core plate 51 of a heat exchanger 1 of the present seventh embodiment, and FIG. 22 is an enlarged plan view illustrating the core plate 51 and the gasket 53 of the heat exchanger 1 of the present seventh embodiment.

As shown in FIGS. 21 and 22, a partitioning seal surface 517 of the core plate 51 of the present embodiment is provided with projection portions 518 that project from the partitioning seal surface 517 in a direction away from the core unit 4. In other words, the projection portions 518 project toward the header tank 5. The projection portions 518 are provided respectively to both end portions of the partitioning seal surface 517 in the air flow direction.

The projection portion 518 has a shape such that the projection portion 518 contacts both corner portions of the first gasket part 53*a* and the second gasket part 53*b*. In the present embodiment, the projection portion 518 has a generally triangular shape, and each corner portion of the triangular shape has an arc shape (so-called rounded shape) of a predetermined radius. Also, the projection portion 518 has a projection height, along which the projection portion 518 projects, and which is set to be a lower value around a lower limit value of a crimping height dimension.

In the heat exchanger 1 of the present embodiment, because the projection portions 518 are formed on the partitioning seal surface 517 of the core plate 51, it is possible to limit the erroneous displacement of the gasket 53 when the end portion of the partition wall 7 adjacent the core plate 51 compress the partitioning seal part 532 of the gasket 53. Also, it is possible to limit the positional displacement of the gasket 53 when the internal pressure of the header tank 5 increases. Due to the above, it is possible to reliably seal between the partition wall 7 and the partitioning seal surface 517 of the core plate 51. As a result, it is possible to reliably improve the sealing performance of partitioning member of the header tank 5.

Also, because the projection portion 518 functions to guide the gasket 53 during the placement of the gasket 53 to the core plate 51, it is possible to improve assemblability of the gasket 53. Furthermore, because the projection portion 518 is designed to be around the lower limit of the crimping height dimension, it is possible to prevent the breakage of the crimped part of the header tank 5 even when the excessive crimp occurs.

Eighth Embodiment

Next, the eighth embodiment of the present invention will be described with reference to FIG. 23. FIG. 23 is a schematic cross-sectional view illustrating a cooling module mounted on a heat exchanger 1 of the present eighth embodiment.

As shown in FIG. 23, the heat exchanger 1 of the present embodiment has a cooling module that includes an air blower 101 and a shroud 102. The air blower 101 supplies air to the heat exchanger 1, and the shroud 102 holds the air blower 101 and guides air flow that passes through the heat exchanger 1.

The shroud 102 has a shroud projection portion 103 formed at a part on a vehicle rear side of the heat exchanger 1, and the shroud projection portion 103 projects toward a vehicle front side. The shroud projection portion 103 is provided to face a part of the core unit 4 of the heat exchanger 1, which part is located in the vicinity of the header tank 5. In the present embodiment, the shroud projection portion 103 is formed integrally with the shroud 102.

Due to the above, in a case, where the fins 3 that is blazed to the dummy tube 23 corrode or fall off, even if the dummy tube 23 that is not received within the core plate 51 may be blown off toward the vehicle rear side due to pressure (ram pressure) caused by air during the vehicle running, the shroud projection portion 103 serves to support the dummy tube 23. As a result, it is possible to prevent the secondary deficiency, such as the erroneous lock of a motor of the air blower 101 caused by the interference between the air blower 101 and the dummy tube 23.

Other Embodiment

The present invention is not limited to the above embodiments, and the present invention may be modified in various manners as below provided that the modification does not deviate from the gist of the present invention.

(1) The above sixth embodiment describes an example of the configuration, in which the first gasket part 53*a* and the corner portion of the second gasket part 53*b* of the gasket 53 are made to have the rounded shape, and in which the connection gasket part 53*c* connects the first gasket part 53*a* with the second gasket part 53*b* over the almost entire length of the first and second gasket parts 53*a*, 53*b* in the air flow direction. However, the present invention is not limited to the above.

For example, as shown in FIG. 24, each of the corner portions of the first gasket part 53*a* and the second gasket part 53*b* may have right angle. Furthermore, the connection gasket parts 53*c* may be provided only at both end portions in the air flow direction to connect the first gasket part 53*a* with the second gasket part 53*b*.

(2) Each of the above embodiments describes an example, in which the tubes 2 are formed in a line, or in other words, the tube insertion bores 511*a* are formed in a line at the tube bonding surface 511 of the core plate 51. However, the present invention is not limited to the above. For example, as shown in FIG. 25, the tube insertion bores 511*a* may be formed in two lines at the tube bonding surface 511 of the core plate 51, and the tubes 2 may be formed in two lines.

(3) The above third embodiment describes an example, in which the two partition walls 7 are provided. However, the present invention is not limited to the above, and there may be provided a single partition wall 7. In the above case, a surface on one side of the partition wall 7 constitutes the first partitioning surface, and a surface on the other side of the partition wall constitutes the second partitioning surface.

(4) In each of the above embodiments, the heat exchanger 1 of the present invention is applied to the heat exchanger that has the first radiator unit 100 and the second radiator unit 200. The first radiator unit 100 cools the engine coolant, and the second radiator unit 200 cools the electrical system coolant. However, the present invention is not limited to the above. However, it is needless to say that, in general, the present invention may be widely applicable to a heat exchanger that has multiple heat exchanger units.

(5) Each of the above embodiments describes an example, in which the dummy tube 23 is provided between the first tubes 21 and the second tubes 22. However, the present invention is not limited to the above, and the dummy tube 23 may not be provided.

(6) The above first embodiment describes an example, in which the single gasket 53 includes a part that seals between the first main body segment 52*a* and the core plate 51 and also includes a part that seals between the second main body segment 52*b* and the core plate 51. In other words, the single gasket 53 integrally includes a gasket that seals between the first main body segment 52*a* and the core plate 51 and a gasket that seals between the second main body segment 52*b* and the core plate 51. However, the present invention is not limited to the above. For example, alternatively, the gasket that seals between the first main body segment 52*a* and the core plate 51 may be configured separately from the gasket that seals between the second main body segment 52*b* and the core plate 51.

(7) Each of the above embodiments may be combined as required if possible.

Additional advantages and modifications will readily occur to those skilled in the art. The invention in its broader terms is therefore not limited to the specific details, representative apparatus, and illustrative examples shown and described.

What is claimed is:

1. A heat exchanger comprising:

a core unit having a plurality of tubes that allows fluid to circulate therethrough; and a pair of header tanks that is positioned at longitudinal end portions of the plurality of tubes, wherein the pair of header tanks extends in a direction orthogonal to a longitudinal direction of the tubes to be communicated with the plurality of tubes, wherein each of the pair of header tanks has a core plate, to which the tubes are bonded, and a tank main body, which together with the core plate defines a tank space, wherein:

the tank main body has at least a first main body segment and a second main body segment;

the header tank is provided with partitioning means that divides the header tank into a first space, which is an internal space of the first main body segment, and a second space, which is an internal space of the second main body segment, such that at least the first space and the second space are arranged in a longitudinal direction of the header tank, wherein the partitioning means has a first partitioning surface that faces the first space and has a second partitioning surface that faces the second space;

a plurality of heat exchanger units is defined by dividing the core unit at the partitioning means in a direction, in which the first space and the second space are arranged;

the core plate has a tube bonding surface, to which the tubes are bonded;

the tube bonding surface has an annular outer peripheral seal surface formed therearound over an entire perimeter of the tube bonding surface, wherein a seal member, which seals between the core plate and an end portion of the tank main body adjacent the core plate, is provided in the annular outer peripheral seal surface;

the tube bonding surface has a partitioning seal surface at a position, which corresponds to the partitioning means, wherein the seal member is provided at the partitioning seal surface to seal between the core plate and the partitioning means;

the partitioning seal surface and the outer peripheral seal surface are coplanar;

the seal member has a part, which is held by the core plate and the tank main body therebetween, and which has a uniform thickness;

the seal member includes:

an annular part that is annularly formed to seal between the outer peripheral seal surface of the core plate and the end portion of the tank main body adjacent the core plate; and a partitioning seal part that seals between the partitioning seal surface of the core plate and the partitioning means;

the annular part is formed integrally with the partitioning seal part; and the partitioning seal part has:

a first surface that faces the partitioning seal surface;

a second surface that is opposite to the first surface and is adjacent to the partitioning means; and a recess that is recessed into a part of the first surface toward the second surface and defines a cavity between the partitioning seal surface and the partitioning seal part.

2. The heat exchanger according to claim 1, further comprising:

a dummy tube that is provided to the core unit at a position, which corresponds to the partitioning means, wherein:

the dummy tube prevents fluid from circulating therethrough; and the dummy tube is not inserted in the core plate.

3. The heat exchanger according to claim 1, further comprising:

at least one rib that is provided between the first main body segment and the second main body segment; and the at least one rib has a plate shape that extends in a direction orthogonal to an air flow direction.

4. The heat exchanger according to claim 1, wherein:

the partitioning means includes:

a first partitioning part that has the first partitioning surface;

a second partitioning part that is spaced apart from the first partitioning part, wherein the second partitioning part has the second partitioning surface; and a connection part that is provided between the first partitioning part and the second partitioning part, wherein the connection part connects an end portion of the first partitioning part adjacent the core plate with an end portion of the second partitioning part adjacent the core plate;

the first partitioning part has an opposite surface that is opposite from the first partitioning surface, wherein the opposite surface of the first partitioning part faces an exterior of the header tank;

the second partitioning part has an opposite surface that is opposite from the second partitioning surface, wherein the opposite surface of the second partitioning part faces the exterior of the header tank;

the connection part is provided at a position that correspond to the partitioning seal surface of the core plate; and the seal member seals between the core plate and the connection part.

5. A heat exchanger comprising:

a first core unit having a plurality of first tubes that allows first fluid to flow therethrough;

a second core unit having a plurality of second tubes that allows second fluid to flow therethrough;

a core plate that is connected with longitudinal end portions of the first tubes and the second tubes;

a first main body segment that is bonded to the core plate, wherein the first main body segment extends in a direction orthogonal to a longitudinal direction of the first tubes such that the first main body segment defines a first space that is communicated with the first tubes;

a second main body segment that is bonded to the core plate, wherein the second main body segment extends in a direction orthogonal to a longitudinal direction of the second tubes such that the second main body segment defines a second space that is communicated with the second tubes, wherein the first space and the second space are arranged in the direction orthogonal to the longitudinal direction of the first tubes and the second tubes;

partitioning means for separating the first space from the second space; and a seal member that seals between the core plate and the first main body segment, seals between the core plate and the second main body segment, and seals between the core plate and the partitioning means, wherein:

the core plate includes a tube bonding surface, an annular outer peripheral seal surface, and a partitioning seal surface, wherein the tube bonding surface has insert bores, into which the first and second tubes are inserted, wherein the annular outer peripheral seal surface is formed around the tube bonding surface and is provided with the seal member, wherein the partitioning seal surface is formed at a position opposed to an end portion of the partitioning means, and is provided with the seal member;

the partitioning seal surface and the outer peripheral seal surface are coplanar;

the seal member has a part, which is held by the core plate and the one of the first main body segment, the second main body segment, the partitioning means therebetween, and which has a uniform thickness;

the seal member includes:

an annular part that is annularly formed to seal between the outer peripheral seal surface of the core plate and the end portion of the tank main body adjacent the core plate; and a partitioning seal part that seals between the partitioning seal surface of the core plate and the partitioning means;

the annular part is formed integrally with the partitioning seal part; and the partitioning seal part has:

a first surface that faces the partitioning seal surface;

a second surface that is opposite to the first surface and is adjacent to the partitioning means; and a recess that is recessed at a part of the first surface toward the second surface and defines a cavity between the partitioning seal surface and the partitioning seal part.

6. The heat exchanger according to claim 5, wherein:

the partitioning means has a first partitioning surface, which faces the first space, and a second partitioning surface, which faces the second space.

7. The heat exchanger according to claim 6, wherein:

the first main body segment is spaced apart from the second main body segment.

8. The heat exchanger according to claim 7, further comprising:

a connection part that connects the first main body segment with the second main body segment.

9. The heat exchanger according to claim 5, further comprising:

a tank main body that integrally has the first main body segment and the second main body segment, wherein:

the partitioning means is a partition wall having a plate shape, wherein the partition wall is provided within the tank main body at a position between the first tubes and the second tubes.

10. The heat exchanger according to claim 1, wherein the partitioning means has an opposed wall seal surface at an end opposing to the partitioning seal surface, the first surface of the partitioning seal part has a contact surface portion at a position other than the recess, the contact surface portion contacting the partitioning seal surface, the opposed wall seal surface of the partitioning means contacts a portion of the second surface of the partitioning seal part, the portion being opposite to the contact surface portion of the first surface, and the partitioning seal part is held between the opposed wall seal surface of the partitioning means and the partitioning seal surface of the core plate to seal between the core plate and the partitioning means.

11. The heat exchanger according to claim 10, wherein the recess extends over an entire length of the partitioning seal part in an air flow direction of the core unit.

12. The heat exchanger according to claim 5, wherein the partitioning means has an opposed wall seal surface at an end opposing to the partitioning seal surface, the first surface of the partitioning seal part has a contact surface portion at a position other than the recess, the contact surface portion contacting the partitioning seal surface, the opposed wall seal surface of the partitioning means contacts a portion of the second surface of the partitioning seal part, the portion being opposite to the contact surface portion of the first surface, and the partitioning seal part is held between the opposed wall seal surface of the partitioning means and the partitioning seal surface of the core plate to seal between the core plate and the partitioning means.

13. The heat exchanger according to claim 12, wherein the recess extends over the entire length of the partitioning seal part in an air flow direction of the first and second core units.

14. The heat exchanger according to claim 1, wherein the recess is located at a substantially middle of the first surface of the partitioning seal part with respect to the longitudinal direction of the header tank.

15. The heat exchanger according to claim 5, wherein the recess is located at a substantially middle of the first surface of the partitioning seal part with respect to a direction in which the first space and the second space are arranged.

16. The heat exchanger according to claim 10, wherein the recess is located at a substantially middle of the first surface of the partitioning seal part with respect to the longitudinal direction of the header tank, and the contact surface portion of the first surface of the partitioning seal part is disposed at opposite sides of the recess with respect to the longitudinal direction of the header tank.

17. The heat exchanger according to claim 12, wherein the recess is located at a substantially middle of the first surface of the partitioning seal part with respect to a direction in which the first space and the second space are arranged, and the contact surface portion of the first surface of the partitioning seal part is disposed at opposite sides of the recess with respect to the direction in which the first space and the second space are arranged.

* * * * *